US006981385B2

(12) United States Patent
Arshansky et al.

(10) Patent No.: US 6,981,385 B2
(45) Date of Patent: Jan. 3, 2006

(54) REFRIGERATION SYSTEM

(75) Inventors: Yakov Arshansky, Conyers, GA (US); David K. Hinde, Rex, GA (US); Richard N. Walker, Monroe, GA (US); Mark Lane, Acworth, GA (US)

(73) Assignee: Delaware Capital Formation, Inc., Wilmington, DE (US)

( * ) Notice: Subject to any disclaimer, the term of this patent is extended or adjusted under 35 U.S.C. 154(b) by 0 days.

(21) Appl. No.: 10/222,767

(22) Filed: Aug. 17, 2002

(65) Prior Publication Data

US 2003/0140638 A1 Jul. 31, 2003

Related U.S. Application Data

(60) Provisional application No. 60/351,265, filed on Jan. 23, 2002, and provisional application No. 60/314,196, filed on Aug. 22, 2001.

(51) Int. Cl.
*F25D 21/06* (2006.01)

(52) U.S. Cl. ..... 62/155; 62/82; 62/282

(58) Field of Classification Search ..... 62/81, 62/82, 175, 155, 156, 276, 282, 288, 277, 62/446, 515; 236/51
See application file for complete search history.

(56) References Cited

U.S. PATENT DOCUMENTS

| | | | |
|---|---|---|---|
| 1,863,427 | A | 6/1932 | Warren |
| 2,181,635 | A | 11/1939 | Tull |

(Continued)

FOREIGN PATENT DOCUMENTS

| | | | |
|---|---|---|---|
| CH | 427 866 | | 1/1967 |
| CH | 440 349 | | 7/1967 |
| DE | 25 05 390 | A1 | 8/1976 |
| EP | 0 701 097 | B1 | 9/1994 |
| EP | 0 675 331 | B1 | 10/1995 |
| EP | 0 602 911 | B1 | 5/1998 |
| EP | 0 916 291 | A1 | 10/1998 |
| EP | 1 134 514 | | 9/2001 |
| EP | 1 139 041 | | 9/2002 |
| GB | 2 185 561 | A | 7/1987 |
| JP | 8-24092 | | 1/1996 |
| JP | 11-230663 | | 8/1999 |
| JP | 2000-274935 | A | 10/2000 |

OTHER PUBLICATIONS

U.S. Appl. No. 10/223,759, filed Aug. 19, 2002, titled "Service Case" (19 pages).

U.S. Appl. No. 60/351,265, filed Jan. 23, 2002, titled "Refrigeration System" (28 pages).

U.S. Appl. No. 60/314,196, filed Aug. 22, 2001, titled "Service Case" (7 pages).

SNOPAN® STEEMPAN® COLPLATE® and other units for efficient, flexible and reliable food display, serving & storage. Tranter, Inc., having a date indication of "09/94", 4 pages.

*Primary Examiner*—Harry B. Tanner
(74) *Attorney, Agent, or Firm*—Foley & Lardner LLP

(57) ABSTRACT

A refrigeration system for objects is disclosed. The system includes a refrigeration device and a defrost system. The refrigeration device provides a case or container defining a space for the objects, a first heat exchanger associated with the container for cooling a fluid communicating with the space to cool the objects and a second heat exchanger to receive a heat supply from an air source for warming the fluid. A system for cooling articles is also disclosed. The system includes a space configured to contain the articles, a first element to provide cooling of the articles within the space, a first coolant source to refrigerate the space by cooling the first element in a first state, and a second coolant source to elevate a temperature of the first element in a second state.

102 Claims, 22 Drawing Sheets

U.S. PATENT DOCUMENTS 2,181,636 A 11/1939 Suanders
2,181,637 A 11/1939 Ardito
2,209,690 A 7/1940 Fraser
2,225,655 A 12/1940 Ottenheimer
2,279,484 A 4/1942 Munshower
2,328,189 A * 8/1943 Brace et al. ..... 62/285
2,379,885 A * 7/1945 Davis ..... 62/256
2,382,599 A 8/1945 Blair
2,425,473 A 8/1947 Hoffman
2,444,593 A 7/1948 Davis
2,495,327 A 1/1950 Hardin
2,513,675 A 7/1950 Quillen
2,607,204 A 8/1952 Kleist ..... 62/116
2,660,864 A 12/1953 Morris
2,663,159 A 12/1953 Ullstrand
2,690,650 A 10/1954 Pichler
2,732,689 A 1/1956 Shreve
2,932,955 A 4/1960 Hargrave et al.
2,973,631 A 3/1961 Adkins
3,230,732 A 1/1966 Rutishauser et al.
3,360,953 A 1/1968 Dieckmann ..... 62/249
3,561,230 A 2/1971 Gatton et al.
3,730,603 A 5/1973 Looms
3,848,426 A 11/1974 Whitney ..... 62/255
3,850,486 A 11/1974 Saxe
3,898,864 A 8/1975 Steelman
4,135,369 A 1/1979 Allgeyer et al.
4,489,995 A 12/1984 Barr ..... 312/236
4,565,070 A 1/1986 Raymond
4,633,677 A 1/1987 Maehara ..... 62/256
4,750,335 A 6/1988 Wallace et al.
4,782,666 A 11/1988 Costan ..... 62/248
4,829,776 A 5/1989 Casanova ..... 62/125
4,949,554 A 8/1990 Branz et al. ..... 62/248
4,984,435 A 1/1991 Seino et al. ..... 62/434
5,042,262 A 8/1991 Gyger et al.
5,046,320 A 9/1991 Loose et al. ..... 62/77
5,048,303 A 9/1991 Campbell et al.
5,217,064 A 6/1993 Kellow et al. ..... 165/48.1
5,293,902 A 3/1994 Lapierie ..... 137/614.04
5,315,837 A 5/1994 Lego
5,323,621 A 6/1994 Subera et al.
5,335,508 A 8/1994 Tippmann ..... 62/129
5,347,827 A 9/1994 Rudick et al.
5,351,498 A 10/1994 Takahashi et al. ..... 62/99
5,357,767 A 10/1994 Roberts ..... 62/256
5,502,979 A 4/1996 Renard ..... 62/256
5,598,886 A 2/1997 Criado-Mellado ..... 165/254
5,626,028 A 5/1997 Graat et al.
5,649,432 A 7/1997 Cavalea, III ..... 62/457.1
5,722,254 A 3/1998 Roth et al. ..... 62/457.9
5,727,393 A * 3/1998 Mahmoudzadeh ..... 62/81
5,743,098 A 4/1998 Behr
5,819,549 A 10/1998 Sherwood
5,887,440 A * 3/1999 Dube ..... 62/82
5,895,111 A 4/1999 Santosuosso et al.
5,911,744 A 6/1999 Kawaguchi
5,921,092 A * 7/1999 Behr et al. ..... 62/81
5,921,096 A 7/1999 Warren
5,924,297 A * 7/1999 Wolff et al. ..... 62/152
5,941,083 A 8/1999 Sada et al.
5,964,512 A 10/1999 Borgen
5,970,734 A 10/1999 Stillwell et al.
6,067,482 A 5/2000 Shapiro
6,067,814 A 5/2000 Imeland ..... 62/384
6,094,925 A 8/2000 Arshansky et al.
6,112,532 A 9/2000 Bakken
6,148,634 A 11/2000 Sherwood ..... 62/434
6,155,075 A * 12/2000 Hanson et al. ..... 62/512
6,170,270 B1 1/2001 Arshansky et al.
6,170,272 B1 1/2001 Backman
6,182,459 B1 2/2001 Hertel
6,196,007 B1 3/2001 Schlosser et al.
6,202,425 B1 3/2001 Arshansky et al.
6,351,964 B1 3/2002 Brancheau et al.
6,412,296 B1 7/2002 Rossi
6,427,468 B1 8/2002 Topper et al.
6,467,294 B1 10/2002 Walker et al.
6,508,066 B1 1/2003 Mierins et al.
6,539,741 B2 4/2003 Navarro
6,601,398 B2 8/2003 Singh et al.
6,619,052 B1 9/2003 Nash, Jr.
6,629,422 B2 10/2003 Wellman
6,647,735 B2 * 11/2003 Street et al. ..... 62/132
6,672,086 B2 1/2004 Zangari et al.
6,672,087 B1 1/2004 Taras et al.
6,684,650 B2 2/2004 Weyna et al. ..... 62/151
6,698,234 B2 3/2004 Gopalnarayanan et al. ... 62/505
6,705,093 B1 3/2004 Taras et al. ..... 62/90
6,711,445 B1 3/2004 Heath et al. ..... 700/3
6,722,149 B1 4/2004 Saroka et al. ..... 62/256
6,745,588 B2 6/2004 Kahler ..... 62/246
6,755,042 B2 6/2004 Chuang et al. ..... 62/256
2001/0023594 A1 9/2001 Ives
2001/0027663 A1 10/2001 Zeigler et al. ..... 62/406
2003/0140638 A1 7/2003 Arshansky et al. ..... 62/155
2004/0003601 A1 1/2004 Dube
2004/0067290 A1 4/2004 Swofford et al. ..... 426/335
2004/0069002 A1 4/2004 Chuang et al. ..... 62/256
2004/0088069 A1 5/2004 Singh ..... 700/108
2004/0123613 A1 7/2004 Chiang et al. ..... 62/246

* cited by examiner

FIGURE 6A
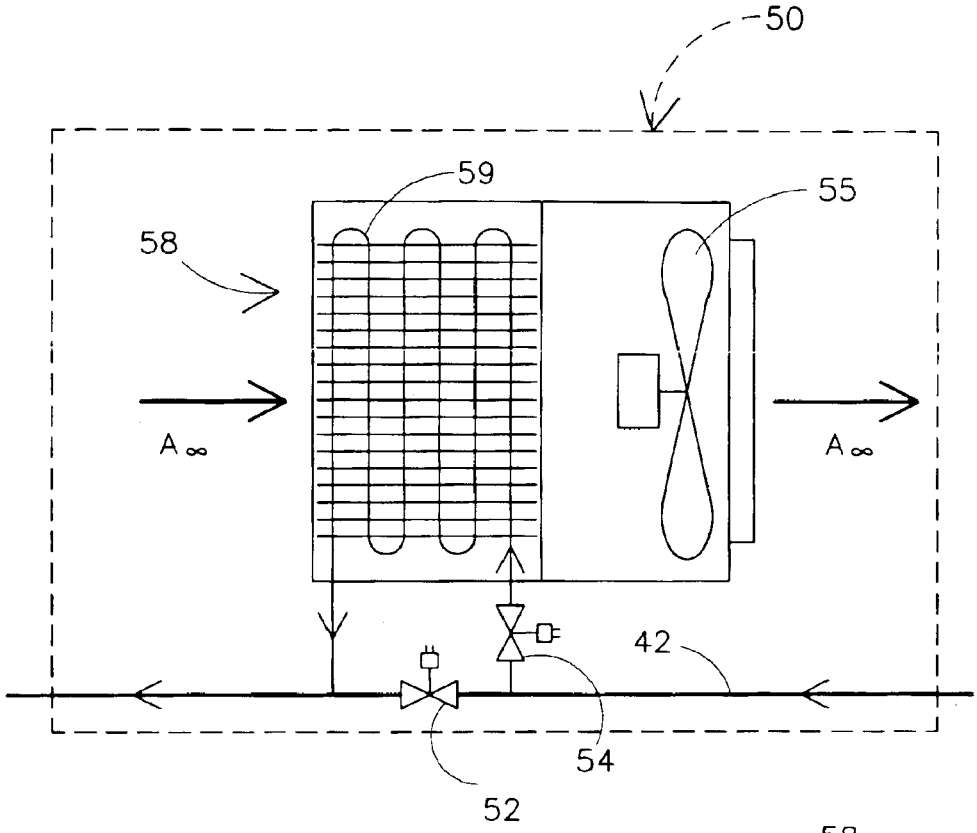
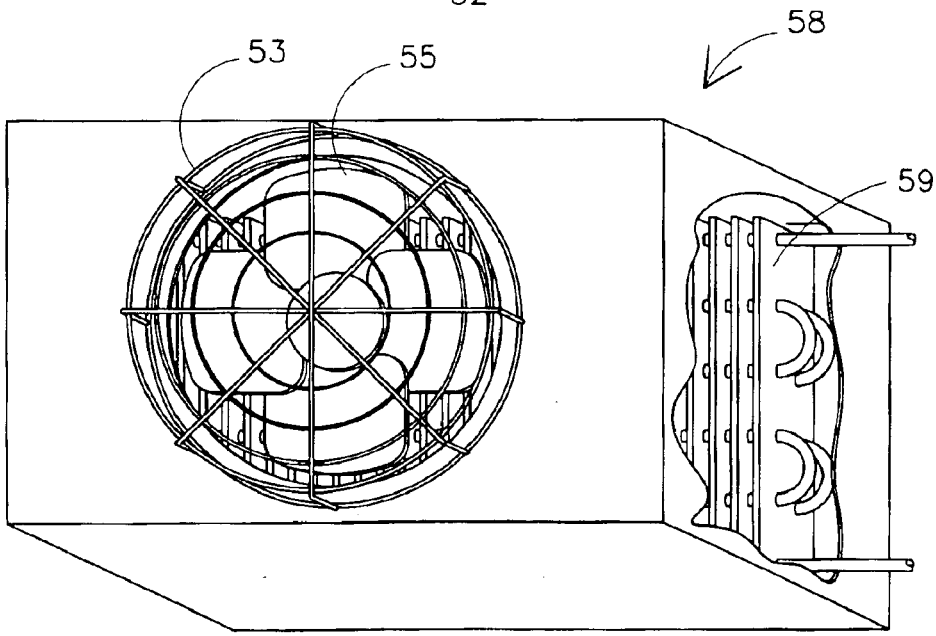
FIGURE 6B

REFRIGERATION SYSTEM

CROSS REFERENCE TO RELATED APPLICATIONS

The present application incorporates by reference and claims priority to the following patent applications: (a) U.S. Provisional Patent Application Ser. No. 60/351,265 titled "Refrigeration System" filed Jan. 23, 2002; and (b) U.S. Provisional Patent Application Ser. No. 60/314,196 titled "Service Case" filed on Aug. 22, 2001.

FIELD OF THE INVENTION

The present invention relates to a refrigeration system. The present invention more particularly relates to a refrigeration system of a type including a refrigeration device and a defrost system. The present invention also more particularly relates to a refrigeration system including one or more refrigeration devices in the form of temperature-controlled cases for objects and materials (such as foodstuffs).

BACKGROUND

It is well known to provide a refrigeration system including a refrigeration device such as a refrigerated case, refrigerator, freezer, etc. for use in commercial and industrial applications involving the storage and/or display of objects, products and materials. For example, it is known to provide a refrigeration system with one or more refrigerated cases for display and storage of frozen or refrigerated foods in a supermarket to maintain the foods at a suitable temperature (e.g. 32 to 35 deg F.). In such applications, such refrigeration systems often are expected to maintain the temperature of a space within the refrigerated case where the objects are contained within a particular range that is suitable for the particular objects, typically well below the room or ambient air temperature within the supermarket. Such known refrigeration systems will typically include a heat exchanger in the form of a cooling element within the refrigeration device and provide a flow of a fluid such as a coolant into the cooling element to refrigerate (i.e. remove heat from) the space within the refrigeration device. Such known refrigeration systems may also include sensors such as thermometers (or thermoswitches) and some type of control system (or timer) intended to provide for the regulation of the temperature within the refrigerated case. Various known configurations of refrigeration systems (e.g. direct expansion system and/or secondary system, etc.) are used to provide a desired temperature within a space in a refrigeration device such as a refrigerated case (e.g. by supply of coolant).

It is also well known that over time in the use of a refrigeration system, ice and/or "frost" may accumulate on the cooling surfaces of a cooling element within the refrigerated case as water vapor condenses and "freezes" on the cooling surfaces. As ice or frost form or accumulate on the cooling surfaces, the ability of the refrigeration system to provide control or regulation of the temperature within the refrigerated case may be impaired. The presence of ice or frost on the cooling surfaces typically reduces the efficiency of heat transfer from the cooling element to the air within the space of the refrigerated case. The accumulated ice or frost may act as an "insulator" on the cooling surfaces and therefore additional energy may be required to maintain the desired temperature within the refrigerated case. The amount of ice or frost that may accumulate on the cooling surfaces may be influenced by a wide variety of factors, such as the humidity level in the air (i.e. moisture), the type of objects within the refrigerated case, the design of the refrigerated case (e.g. open or enclosed by doors or the like), the nature or manner of use, the environment in which the refrigerated case is used, etc.

It is known to provide a defrost system for a refrigeration system. The general intent of such known defrost systems is to remove the accumulated ice or frost from the cooling surfaces, typically by elevating the temperature of the cooling surfaces above the ice-water freezing point (i.e. above 32 deg F.) so that any ice and frost that may have accumulated will melt. According to one known arrangement, the defrost system may simply involve temporarily turning off the refrigeration system (i.e. interrupting the flow of coolant to the cooling elements within the refrigerated case) for a designated time. This arrangement may not be able to achieve the objective of removal of the ice and frost within a suitable period of time; variations in the temperature within the refrigerated case may be unacceptable, requiring that the objects be removed from the refrigerated case. According to another known arrangement, the defrost system includes electric heating elements installed within the refrigerated case (near the cooling elements) and periodically energized to heat the cooling surfaces to melt the ice and frost. This arrangement may provide for the removal of ice and frost within a suitable period of time, but requires additional energy and may cause thermal shock or undue heating of objects within the refrigerated case; in addition, thermal cycling may accelerate fatigue and failure of materials within the refrigerated case. According to another known arrangement, the defrost system may be configured to periodically divert or route warm coolant (such as liquid refrigerant or hot gas) otherwise present within the refrigeration cycle of the refrigeration system through the cooling element within the refrigerated case in order to melt the accumulated ice and frost from the cooling surfaces. This arrangement is relatively complex to install and may also result in temperature variations and/or thermal cycling that could have an adverse effect on the refrigerated case or objects within the refrigerated case; this arrangement may also be relatively expensive to install and may create thermal stresses that may tend to increase the possibility of leaks. Such known arrangements for a defrost system typically do not provide for a cost-effective and controllable process for removing ice and frost from the cooling surfaces of the refrigerated case.

Accordingly, it would be advantageous to provide a refrigeration system of a type having at least one refrigeration device (such as a refrigerated case) with a defrost system that can be installed and operated in a relatively cost-efficient and energy-efficient manner. It would also be advantageous to provide for a defrost system that allows for relatively "tight" control of the temperature within the refrigerated case (and of objects within the refrigerated case). It would further be advantageous to provide a defrost system for a refrigeration system that operates relatively quickly to remove ice and frost from cooling surfaces within the refrigerated case but does not require or result in any potentially harmful variation of the temperature of objects within the refrigerated case. It would be further advantageous to provide a defrost system that has a relatively compact modular design that can be used with any of a wide variety of refrigeration systems and refrigerated cases. It would further be advantageous to provide a defrost system that is configured to use a source of heat that is conveniently and readily available within the environment where the refrigeration system is installed.

It would be advantageous to provide a refrigeration system with a defrost system having any one or more of these or other advantageous features.

SUMMARY

The present invention relates to a system for refrigeration of objects and includes a container defining a space adapted to receive the objects, a first heat exchanger associated with the container for cooling a fluid communicating with the space to cool the objects, and a second heat exchanger adapted to receive a heat supply from an air source for warming the fluid.

The present invention also relates to a refrigeration device having a primary cooling system with a primary fluid in thermal communication with a first heat exchanger and a secondary cooling system with a secondary fluid in thermal communication with the first heat exchanger to cool the secondary fluid and in thermal communication with at least one cooling device adapted to provide cooling to a space to be cooled in a first mode of operation, the refrigeration device having a second heat exchanger in communication with the secondary cooling system and in communication with a heat source to warm the secondary fluid in a second mode of operation.

The present invention further relates to a defrost system for a refrigeration device having a primary cooling system having a first loop in thermal communication with a secondary cooling system configured for flow of a coolant therethrough, where the defrost system includes a heat exchanger in thermal communication with the coolant to transfer a quantity of heat from an air source to the coolant, and a control system operable to warm the coolant in the heat exchange device during a defrost mode and operable to cool the coolant during a cooling mode.

The present invention further relates to a method of defrosting a refrigeration device having a primary loop with a refrigerant configured to remove a first quantity of heat from a coolant in a secondary loop, where the method includes providing at least one cooling element in the refrigeration device to cool a space, where the cooling element communicates with the secondary loop, providing a heat exchanger communicating with the secondary loop to transfer a second quantity of heat from an air source to the coolant in a first mode, and providing a control system to route the coolant in a first flow path when the cooling element is in the first mode and operable to route the coolant in a second flow path when the cooling element is in a second mode.

The present invention further relates to an ambient air defrost system for a temperature controlled display device having a first loop circulating a refrigerant, a second loop circulating a coolant and communicating with at least one cooling element for cooling a space, and a first heat exchanger communicating between the first loop and the second loop, where the first heat exchanger transfers a first quantity of heat between the second loop and the first loop, and the ambient air defrost system includes a control system to control operation of the temperature controlled display device in an operating mode and a defrost mode, and a second heat exchanger communicating with the second loop to transfer a second quantity of heat between an ambient air source and the coolant during the defrost mode.

The present invention further relates to a system for cooling articles and includes a space configured to contain the articles, a first element adapted to provide cooling of the articles within the space, a first source of fluid adapted to refrigerate the space by cooling the first element in a first state, and a second source of fluid adapted to elevate a temperature of the first element in a second state.

The present invention further relates to a method of operating a refrigeration device adapted to operate in a defrost mode and with a coolant flowing through a cooling element of a type that may tend to accumulate frost. The method includes routing the coolant to a heat exchanger and routing the coolant to a cooling element at a flow rate, wherein the heat exchanger elevates a temperature of the coolant using ambient air so that any frost on the cooling element can be at least partially removed when the coolant is routed to the cooling element.

The present invention further relates to a method of installing a refrigeration system having a coolant adapted to circulate in a piping network with a flow rate to a cooling element and includes coupling the piping network to a coolant source. The method includes configuring a control system to transmit the coolant to a heat exchanger for warming the coolant with an ambient air source, and balancing the flow rate of the coolant to the cooling element.

BRIEF DESCRIPTION OF THE DRAWINGS

FIG. 6A is a schematic diagram of a defrost system according to an exemplary embodiment.

FIG. 6B is a perspective view of the defrost system of FIG. 6A.

DETAILED DESCRIPTION OF THE PREFERRED AND OTHER EXEMPLARY EMBODIMENTS

Figure 1:
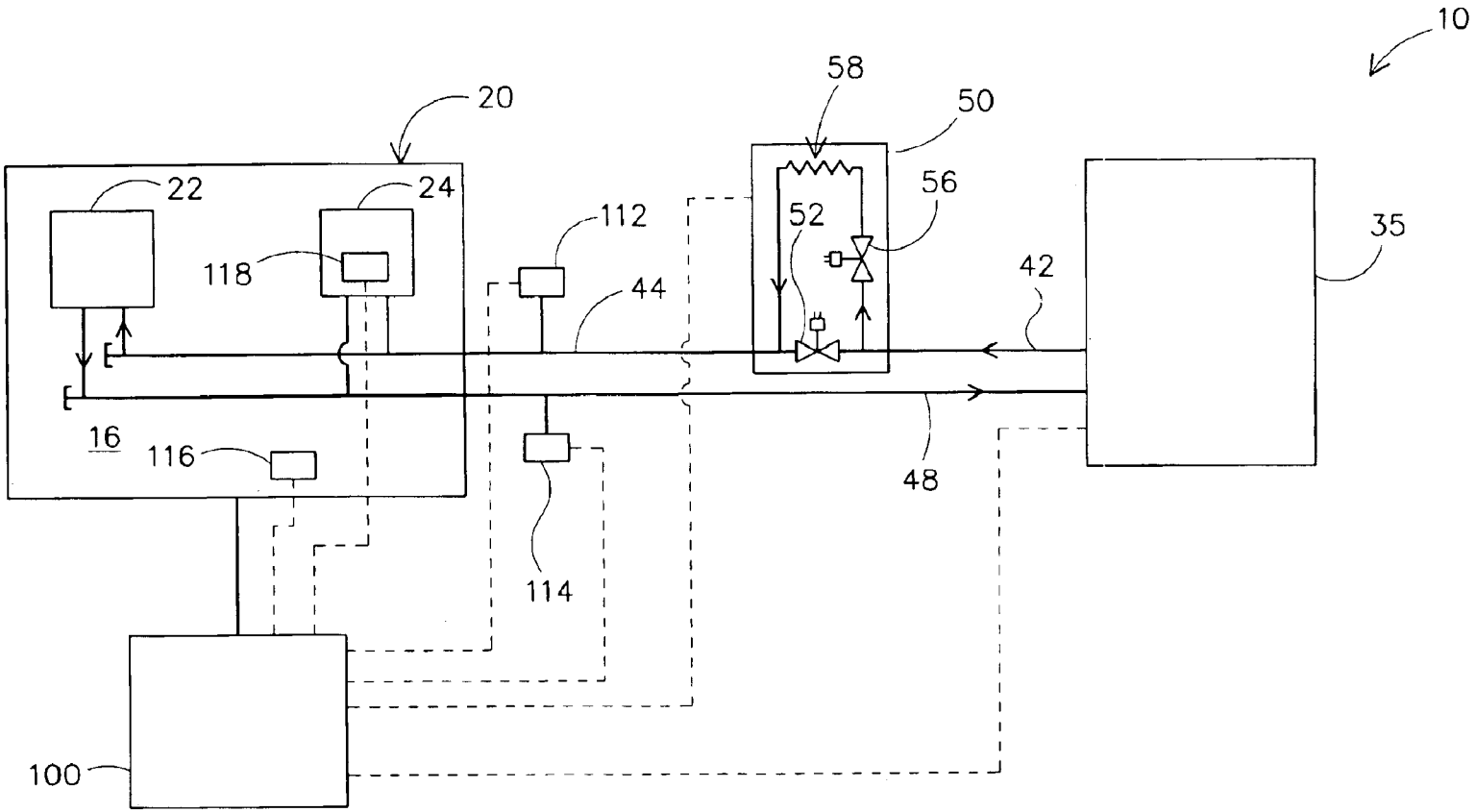
FIG. 1 is a schematic diagram of a refrigeration system according to an exemplary embodiment.

Referring to FIG. 1, a refrigeration system 10 is shown according to an exemplary embodiment. System 10 (shown schematically) may include any one or more of a wide variety of temperature-controlled equipment (shown schematically as refrigeration devices 20). According to other exemplary embodiments the refrigeration system may be adapted to include refrigeration devices of any of a variety of types or configurations (for example, temperature controlled cases such as refrigerated cases 120 or 220 or 320 or 420 as shown in FIGS. 5A through 5D, or any other type of refrigerator, freezer, cooler, temperature-controlled storage, display case, etc.) that may be used in commercial, industrial, residential or any other applications providing a container or case (in an open or closed configuration) for refrigeration of materials. According to any preferred embodiment, the refrigeration devices will be configured to operate in a standard cooling mode (e.g. to maintain a desired temperature and/or refrigerate objects shown schematically as foodstuffs 15 or products or materials in FIGS. 5A through 5D). According to any preferred embodiment, the refrigeration devices may be configured as an open-front type case 120 (shown schematically in FIG. 5A), a closed-front type case 220 (shown schematically in FIG. 5B), a forced-air type case 320 (shown schematically in FIG. 5C) and/or a gravity-type case 420 (shown schematically in FIG. 5D).

According to an exemplary embodiment shown in FIG. 1, refrigeration system 10 includes refrigeration device 20, a cooling/refrigerating system 35 (providing a supply fluid such as a coolant in a loop or flow path to refrigeration device 20) and a defrost system 50. System 10 may also include a control system 100. Refrigeration device 20 includes heat exchangers (shown as a cooling device 22 and a cooling device 24) having cooling elements which may provide cooling surfaces configured to refrigerate or otherwise provide temperature control in a space 16 within refrigeration device 20. According, to any exemplary embodiment, the system may include any number of heat exchangers of any suitable type and configuration within the refrigeration device to provide the intended temperature control for a particular application (such as refrigeration or freezing of foodstuffs).

Figure 2A:
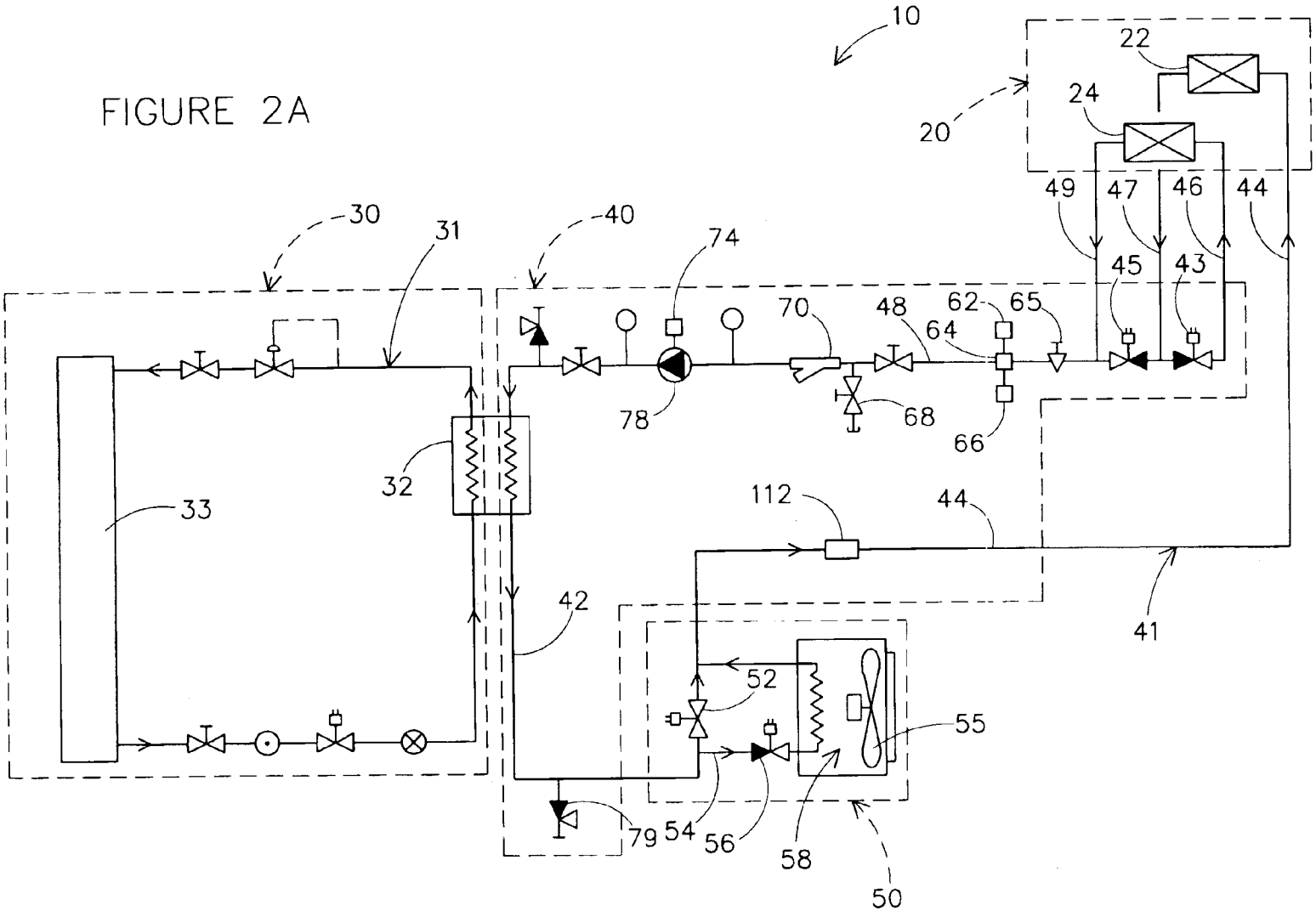
FIG. 2A is a schematic diagram of a refrigeration system with a single refrigeration device according to an exemplary embodiment.

As, shown according to the exemplary embodiment of FIG. 1, system 10 also includes a defrost system 50. Defrost system 50 receives coolant from a source shown as cooling/refrigerating system 35 and may be coupled to and/or integrated with a cooling system for the refrigeration device (e.g. as shown in FIG. 2A for secondary system 40 on supply line 42). According to any exemplary embodiment, the coolant may be a primary coolant such as a liquid refrigerant (e.g. saline or salt solution, ammonia, or other refrigerant), or the coolant may be a secondary coolant (e.g. glycol, propylene glycol provided with or without inhibitor chemicals, etc.) from a secondary cooling system that is configured to exchange heat with a primary cooling system.

Figure 9:
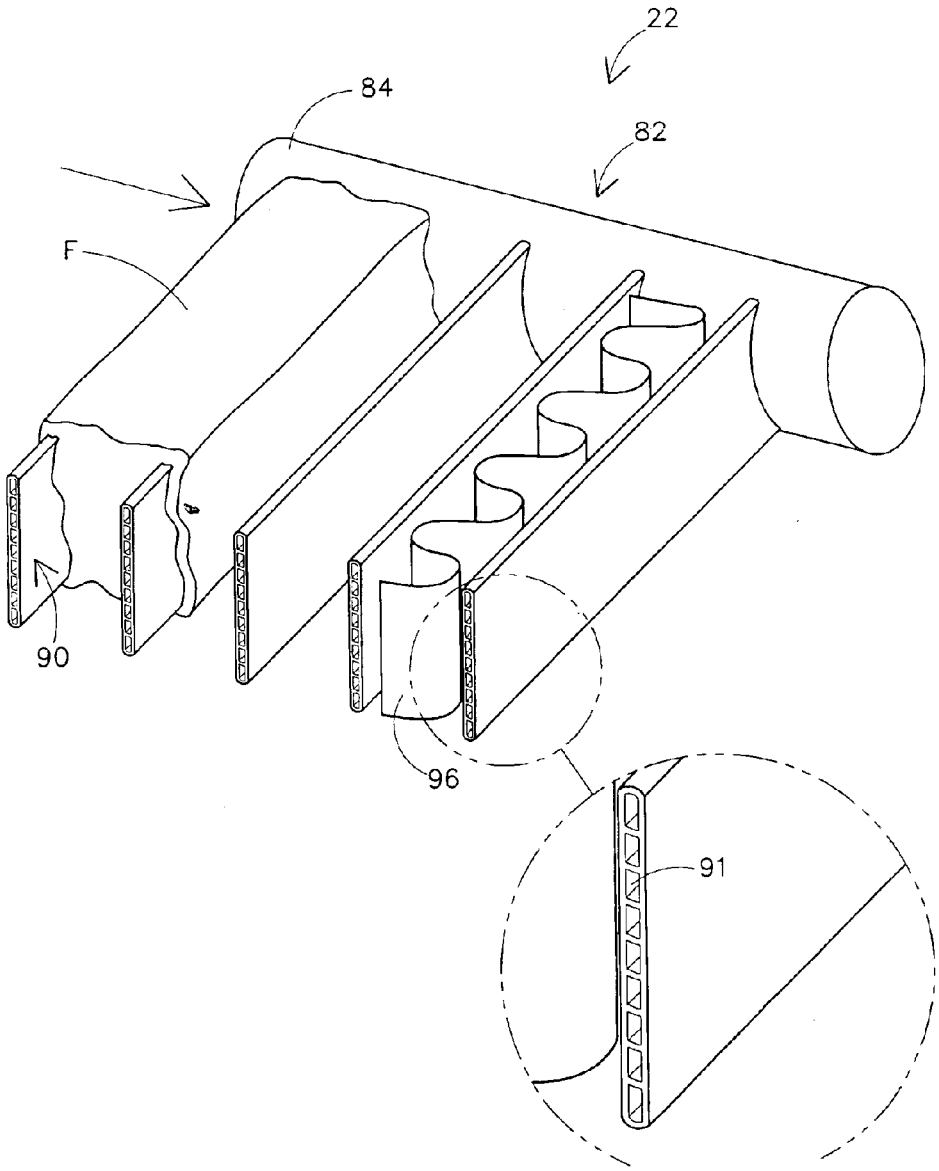
FIG. 9 is a perspective view of a cooling element for a refrigeration system according to an exemplary embodiment.

According to a preferred embodiment, the defrost system is normally bypassed during the standard or "cooling" mode of operation of the refrigeration device; the defrost system provides for a "defrost" mode of operation when it is determined (or otherwise scheduled or selected) to remove any possible build up of frost (shown schematically as frost layer F on cooling element 22 in FIG. 9) that may have formed upon the surface of (one or more of) the cooling elements within the refrigeration device. According to an exemplary embodiment, during the "defrost" mode of operation, operation of the cooling mode of the system is temporarily interrupted and the defrost system is activated and the fluid (e.g. coolant of the refrigeration device) from the supply line of the cooling system is directed to the defrost system where it is warmed (e.g. elevated to a temperature above freezing) and routed to the cooling elements. The flow of the warmed coolant through (one or more of) the cooling elements of the refrigeration device is intended to warm and defrost the cooling surfaces of the cooling elements.

According to an exemplary embodiment shown in FIG. 2A, defrost system 50 (see FIGS. 6A through 6D and 6G through 6H) includes a heat exchanger 58 configured to transfer heat from a heat source to the coolant (during the defrost mode) to warm the coolant. According to a particularly preferred embodiment (shown schematically in FIGS. 2A through 2C), defrost system 50 is configured to use ambient air (e.g. from an indoor supply, other temperature-regulated space or other environment) as a heat source to warm the coolant; according to any preferred embodiment, ambient air (or another heat source) will be readily available in the facility or environment where the refrigeration device has been installed as a consistent and reliable supply of heat for warming the coolant to allow operation of the system in the defrost mode. According to a particularly preferred embodiment, the heat exchanger is a fan coil unit commercially available from Cancoil USA, Inc. of Danville, Ill. (a subsidiary of Cancoil Thermal Corp. of Kingston, Ontario, Canada), for example as Model No. HFFC00101A (or other suitable unit from Heatcraft Refrigeration Products of Stone Mountain, Ga.). According to other alternative embodiments, any suitable heat exchanger (with or without a fan) may be used to provide or otherwise facilitate the desired heat transfer from the air source to the coolant. According to a particularly preferred embodiment, the heat exchanger used with the defrost system is of a type used for the refrigeration of supply rooms or walk-in type coolers (e.g. a "unit cooler"); according to any preferred embodiment, the size, capacity and configuration of the heat exchanger can be matched to the specific or anticipated loads or performance demands on the defrost system within the given application. According to an alternative embodiment, the defrost system may include a supplemental and/or separate heating element (e.g. an electric heater, etc.) to heat the coolant in the defrost mode and/or as a backup heat source. Operational parameters, including the frequency of the defrosting, the duration of defrost mode, the flow rate of coolant, the flow rate of air, the temperature set points (e.g. for supply coolant, return coolant, air within the refrigerated case), as well as the order or sequence within which particular or individual cooling elements are to be defrosted, will vary according to various alternative or other exemplary embodiments according to the type of refrigeration device, the configuration and type of the cooling elements, the ambient conditions (e.g. humidity and temperature), the nature of the refrigerated objects, the set point or preferred temperatures for the refrigeration device (e.g. case), etc. and may be adjusted as may be necessary based on observation of system performance at or after installation.

Figure 2B:
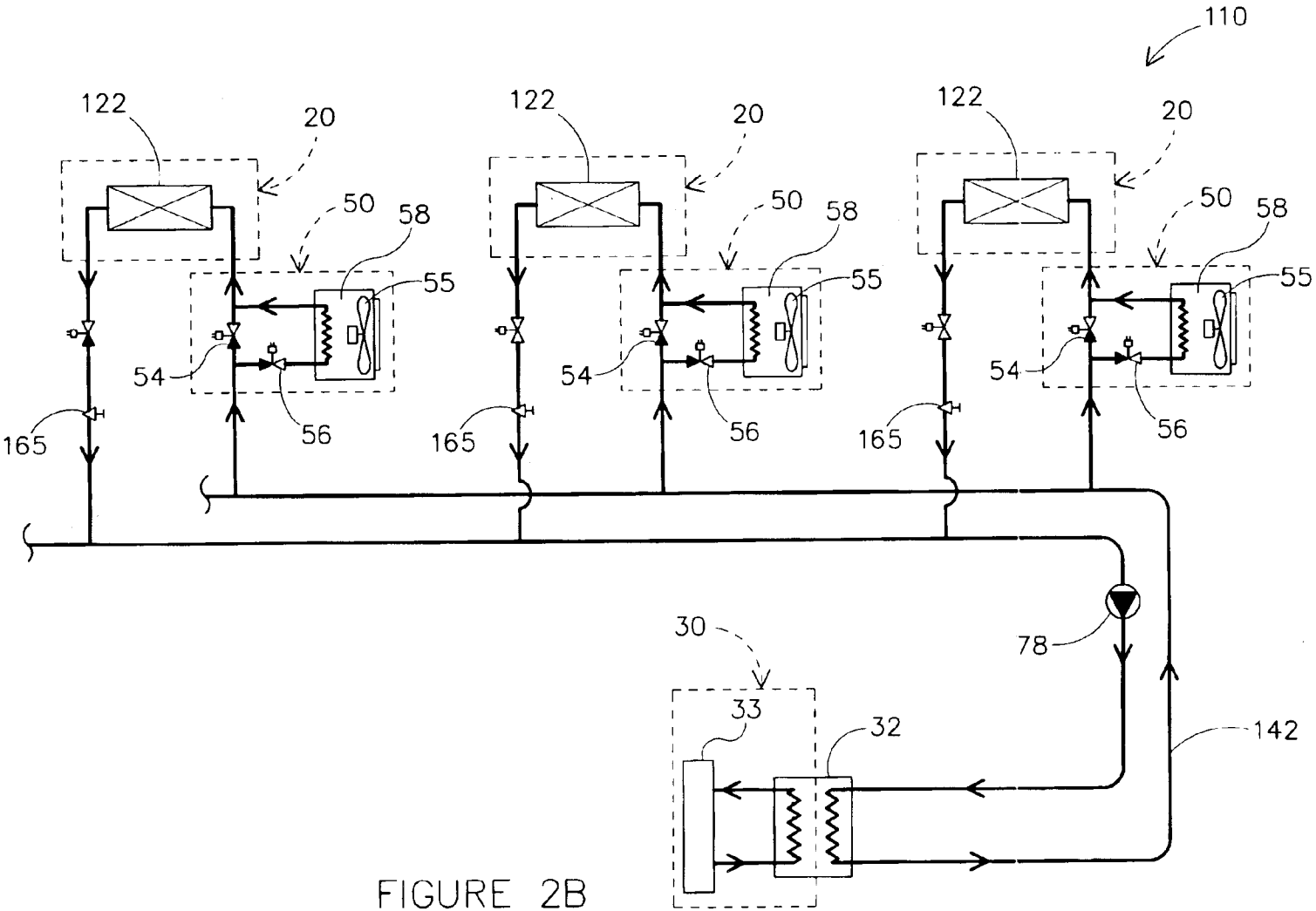
FIG. 2B is a schematic diagram of a refrigeration system with multiple refrigeration devices according to an exemplary embodiment.

As shown according to an exemplary embodiment in FIG. 2B, a system 110 having multiple refrigeration devices 20 may be provided with multiple defrost systems 50. The refrigeration devices and defrost systems may be interconnected as a network with suitable branches (flow paths or circuits) for distributing the coolant. As shown, defrost system 50 is provided for each refrigeration device 20 and is preferably integrated with the supply line 142 of the cooling system. The defrost systems may be physically integrated into the refrigeration device (such as in the base, etc.) or located adjacent to the refrigeration device (e.g. beneath, behind, etc.). Flow regulating devices (e.g. valves, etc. shown schematically as balance valves 165) may be provided for "balancing" the flow rate of the coolant through the circuits to the refrigeration devices. Balancing may, be conducted during initial setup of the refrigeration system, or when one or more refrigeration devices are added or modified; balancing may also be required if the operational parameters and/or configuration or intended use of the refrigeration device are modified or adjusted (e.g. for different product loading requirements, temperature ranges, etc.).

Defrost system 50 may be configured for separate control to defrost each of the refrigeration devices (and/or specific cooling elements within each of the refrigeration devices) based on the particular configuration and/or demands and use conditions of each of the refrigeration devices. According to a preferred embodiment, each cooling element (or each set of cooling elements) within a refrigeration device will be configured (by control elements such as valves/headers) to be defrosted according to an individual and pre-determined routine; certain types of cooling elements (e.g. upper cooling elements 22 shown in FIG. 5D) may be defrosted more frequently and by a different duration or "profile" than other types of cooling elements (e.g. lower pan 24 shown in FIG. 5D) within the same refrigeration device (e.g. refrigeration device 420 shown in FIG. 5D). According to an alternative embodiment, the defrost system may be configured for defrost of each refrigeration device (or each cooling element within a refrigeration device) simultaneously (or in some other predetermined sequence). According to an alternative embodiment, multiple refrigerated cases (or cooling elements within a refrigerated case) may share one or more defrost systems. According to other alternative embodiments, certain of the cooling devices and/or cooling elements within one or more refrigerated cases may be interconnected or networked to a single defrost system or otherwise configured to selectively and/or individually operate in defrost mode.

Figure 2C:
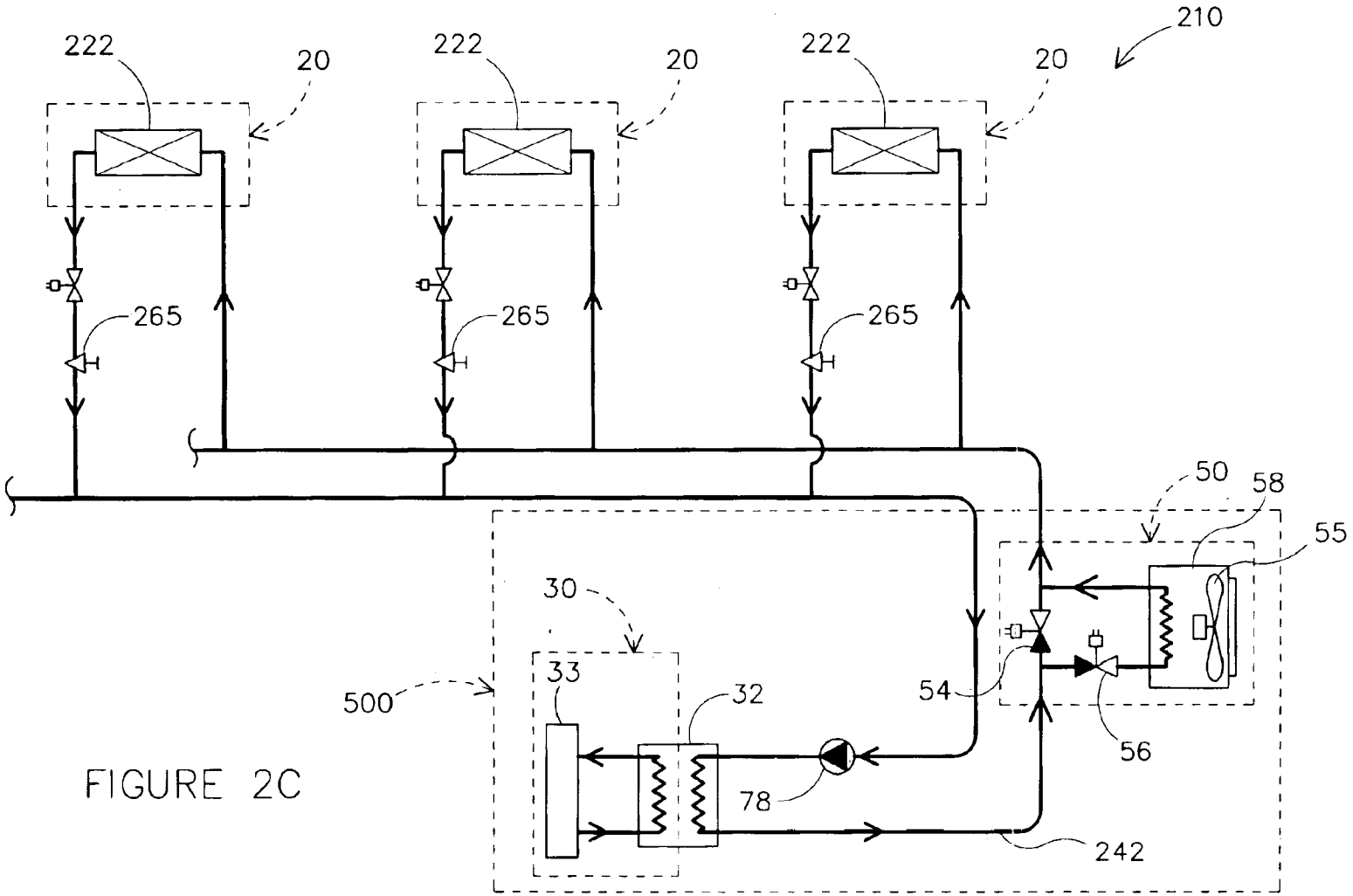
FIG. 2C is a schematic diagram of a refrigeration system with multiple refrigeration devices according to an alternative embodiment.

As shown in FIG. 2C, a refrigeration system 210 includes a cooling and defrost system 500 for use with one or more refrigeration devices 20. Cooling and defrost system 500 includes primary cooling system 30, secondary cooling system 240 and defrost system 50 (see FIGS. 6A through 6D). Defrost system 50 is shown schematically as a centralized defrost system provided for each refrigeration device 20 and is preferably integrated with the supply line 242 of coolant (i.e. supply or secondary fluid) from secondary cooling system 240. Flow regulating devices (e.g. valves, etc. shown schematically as balance valves 265) may be provided for balancing the flow rate of the coolant through the circuits to the refrigeration devices 20. According to an alternative embodiment, the defrost system may be provided in a centralized or remote location from the refrigeration devices (associated with the supply or return lines), as may be most suitable or convenient for the application or facility where the refrigeration system is installed. Cooling and defrost system 500 may be used with any suitable refrigeration device as shown for example in FIGS. 5A–5D. Such refrigeration devices (shown as a refrigerated case providing a space) may include suitable components (shown schematically as fans 17 in FIGS. 5A–5C) for distributing air A within the space for cooling the objects (shown schematically as products 15). According to alternative embodiments, any number of refrigeration devices and defrost systems may be interconnected in various other configurations as a network (with suitable branches or circuits for distributing the coolant). According to other alternative embodiments, the cooling and defrost system may include other components or equipment suitable for supply a coolant to the refrigeration devices.

Figure 2D:
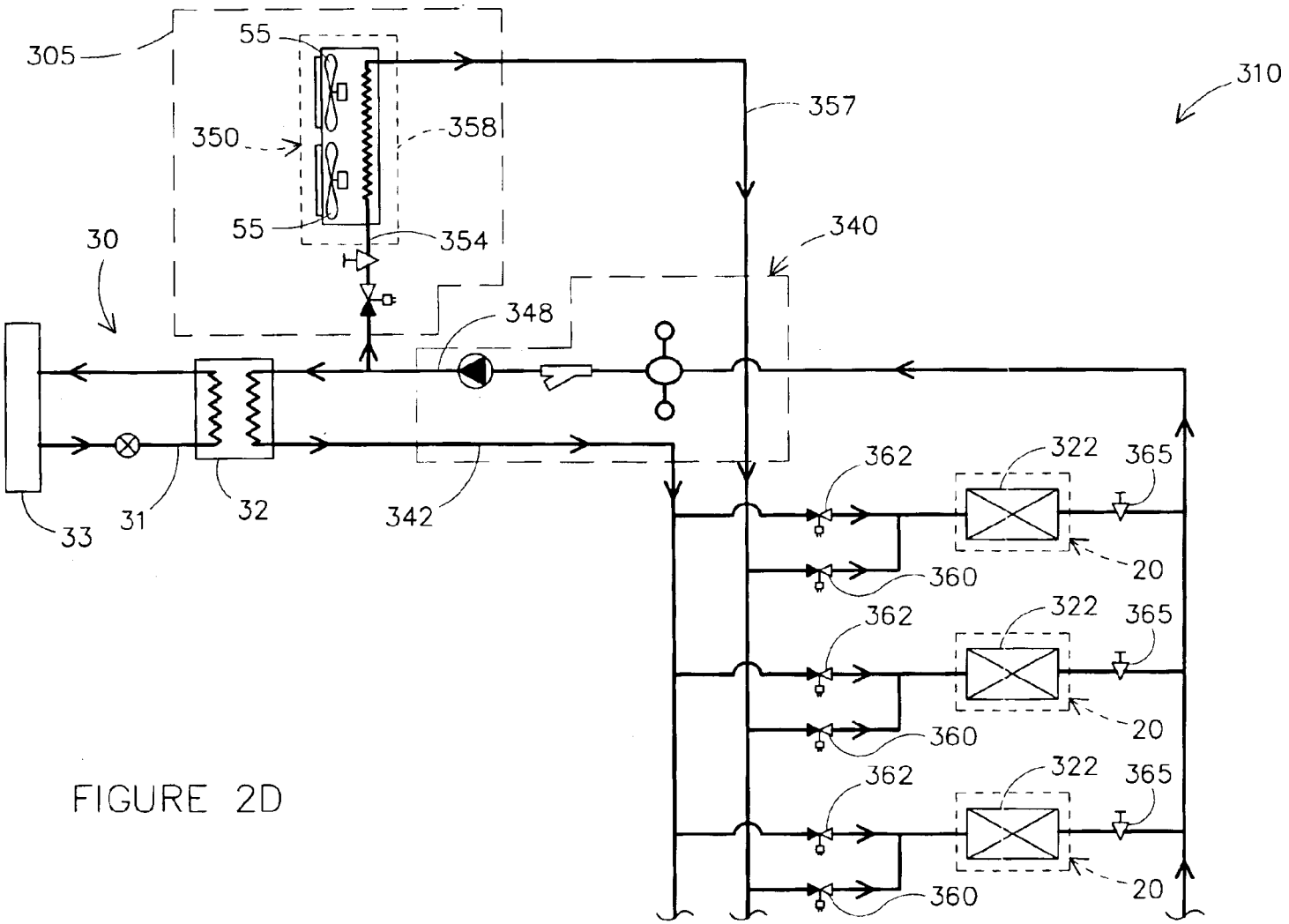
FIG. 2D is a schematic diagram of a refrigeration system with multiple refrigeration devices according to an alternative embodiment.

Referring to FIG. 2D, a refrigeration system 310 may be provided with multiple refrigeration devices 20 (i.e. representative of a certain portion or all of the refrigeration devices in the facility) as shown according to a preferred embodiment. The refrigeration devices may be interconnected as a network with suitable branches or circuits for distributing the coolant. Defrost system 350 (see FIGS. 6E through 6F) is shown as a "centralized" defrost system provided for each of the refrigeration devices 20 and is preferably integrated with the return line 348 of secondary cooling system 340. Flow regulating devices (e.g. valves, etc. shown schematically as balance valves 365) may be provided for balancing the flow rate of the coolant through the circuits to the refrigeration devices. Defrost system 350 receives a supply of coolant (e.g. supply fluid) through defrost return line 354 from coolant return line 348 for warming the fluid for use in defrosting one or more cooling devices 322 in each of the multiple refrigeration devices 20. Defrost system 350 provides a supply of warmed fluid (coolant) through defrost supply line 357 and valves 360 to refrigeration devices 20. During a cooling mode of operation, cooling supply valves 362 are open for circulating coolant to the cooling devices 322 in each refrigeration device and defrost supply valve 360 is closed. (The defrost system 350 may be provided in a remote location from one or more of the refrigeration devices.) In a particularly preferred embodiment, defrost system 350 is located in a high temperature area 305 of a facility. For example, in a facility such as a supermarket, the defrost system may be located in a bakery area, equipment or machine room (or any other space or room in which heat may be generated, such as by compressors or other mechanical equipment) or other suitable area having a suitable (or higher) ambient temperature level than other areas of the facility. (Location of the defrost system in such higher-temperature areas provides a higher level of heat available for use by the defrost system for warming the coolant fluid and also utilizes waste heat and may reduce air conditioning or ventilation demand in the facility or area.) According to an alternative embodiment, the defrost system may be located in any suitable area or facility having an ambient air supply at any suitable temperature (within the base or structure of or adjacent to a refrigeration device).

Figure 2E:
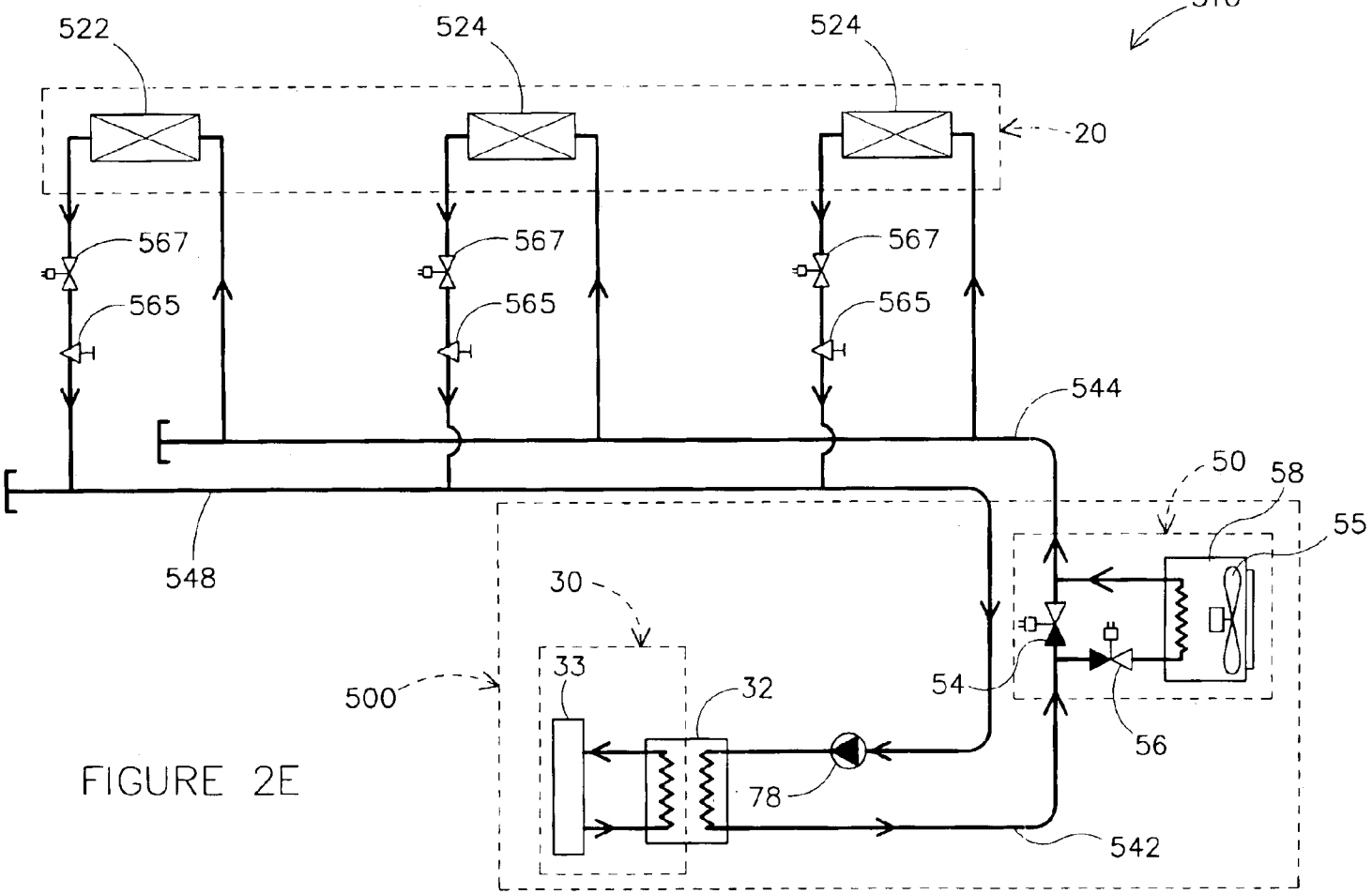
FIG. 2E is a schematic diagram of a refrigeration system with a single refrigeration device with multiple cooling elements according to an exemplary embodiment.

As shown in FIG. 2E, a refrigeration system 510 includes a defrost system 50 for use with a refrigeration device 20 having multiple cooling elements (shown schematically as upper cooling element 522 and lower cooling elements 524). Secondary coolant is provided to each cooling element in a piping network (shown as parallel circuits or flow paths) from a coolant supply line 544. The secondary coolant is returned from the cooling elements through a coolant return line 548. According to a particularly preferred embodiment, the cooling elements in the refrigerated case may be defrosted individually or in any suitable combination as determined to be necessary or appropriate by the control system. Flow regulating devices (e.g. valves, etc. shown schematically as solenoid valves 567) on the outlet line of the cooling elements may be opened during the defrost mode for defrosting of the cooling element or may be closed during the defrost mode if defrosting of the cooling element is not desired or required. According to an alternative embodiment, the piping network to the cooling elements may be provided in any suitable configuration (e.g. interconnection in a parallel-series configuration, etc.) to provide a desired defrosting configuration for the cooling elements. According to another alternative embodiment, the valves may be provided on the inlet or supply side of the cooling elements. According to a further alternative embodiment, the flow control elements may be included within the cooling elements or in a portion of a header or manifold for the cooling elements.

Figure 6C:
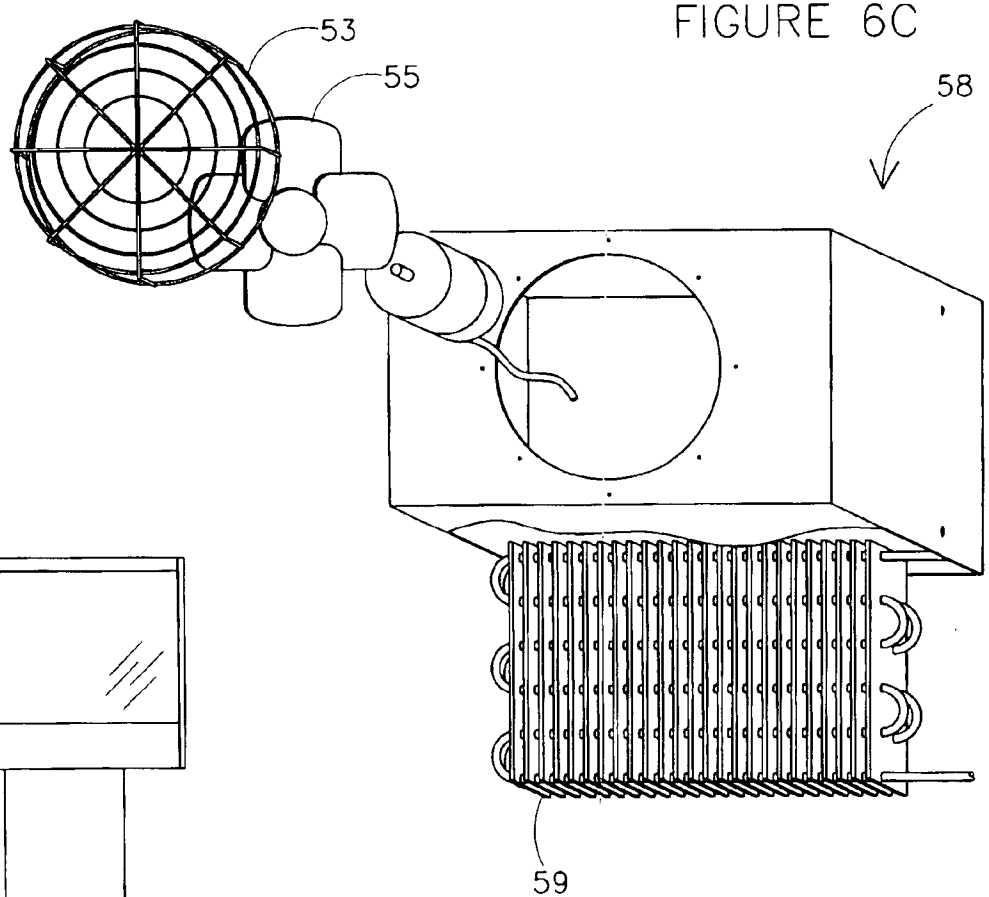
FIG. 6C is an exploded perspective view of the defrost system of FIG. 6A.
Figure 6D:
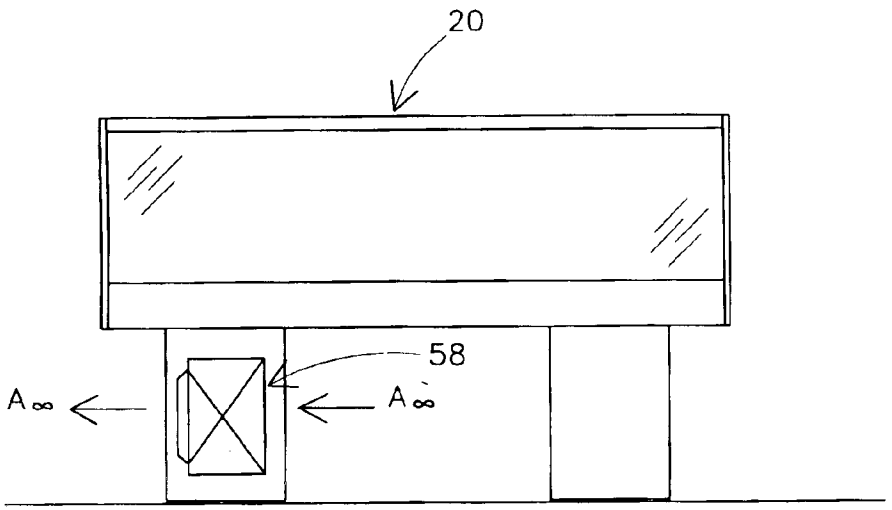
FIG. 6D is a front elevation view of the defrost system of FIG. 6A.
Figure 6E:
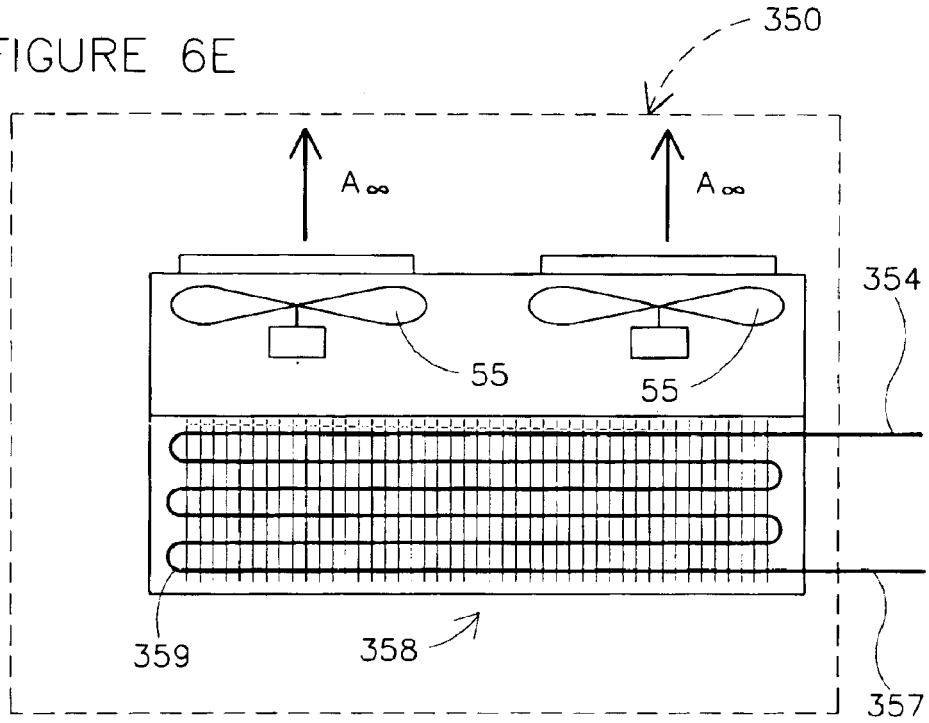
FIG. 6E is a schematic diagram of a defrost system according to another preferred embodiment.

According to a preferred embodiment shown in FIGS. 2A through 2C and 2E, heat exchanger 58 (also shown as heat exchanger 358 in FIG. 2D) of defrost system 50 provides a surface or surfaces such as channels or fins associated with a coil 59 (also shown as coil 359 in FIG. 2D) (through which coolant or supply fluid will flow) in a configuration to promote heat transfer by flow of air (e.g. by convection through the use of a device shown schematically as a fan 55) (see FIGS. 6A, 6D and 6E). According to a preferred embodiment, heat exchanger 58 transfers heat from the ambient air heat source to the coolant (e.g. by fins or channels to coil 59). According to any particularly preferred embodiment, the ambient air heat source is preferably from a relatively temperature-stable environment, such as a building interior air supply or space of a supermarket (typically regulated at approximately 75 deg F.), or other facility housing the refrigeration system. The relatively temperature stable environment within a supermarket or interior space of another facility will typically provide a relatively constant and reliable heat source for use by the defrost system; according to any preferred embodiment, the defrost system will be installed in the environment allowing suitable temperature stability and performance of the defrost system that can be generally well-controlled and operation is consistent (and predictable within a range after installation of the defrost system). According to alternative embodiments, the heat source may be any indoor or environmental air supply (preferably having a relatively constant and stable temperature greater than the coolant), such as bakery or cooking areas having ovens or other heat generating devices (e.g. warmers, toasters, etc.), equipment rooms having equipment (e.g. compressors, condensers, etc.) heating loads, overhead locations within a building having elevated temperature due to lighting and other heat loads, the waste or exhaust heat from other devices including, for example, the primary cooling system condenser, electrical devices such as transformers, or exhaust from combustion chambers, or other heat generating devices such as ovens, furnaces, etc. (According to other alternative embodiments, the heat exchanger for the defrost system may be a liquid cooled heat exchanger using an ambient temperature water supply, hot water supply or other available heat source within the facility that will relatively consistently provide the desired amount of heat to the coolant during the defrosting mode of operation.)

In any exemplary embodiment, during initial installation and operation of the refrigeration system, the coolant system will be balanced (such as by adjusting valve 65 as shown in FIG. 2A, valves 165 as shown in FIG. 2B, valves 265 as shown in FIG. 2C, valves 365 as shown in FIG. 2D and valves 565 as shown in FIG. 2E) to provide the desired coolant flow rates through each circuit corresponding to any one or more refrigeration devices included in the refrigeration system. (Balancing for any exemplary system will depend upon the type or style of the refrigeration device (e.g. open or closed case or environment, number of cooling elements, etc.), the desired defrost frequency and duration, the fluid temperature available from the defrost system, according to technologies that are commonly known to those of ordinary skill in the art.)

Figure 5A:
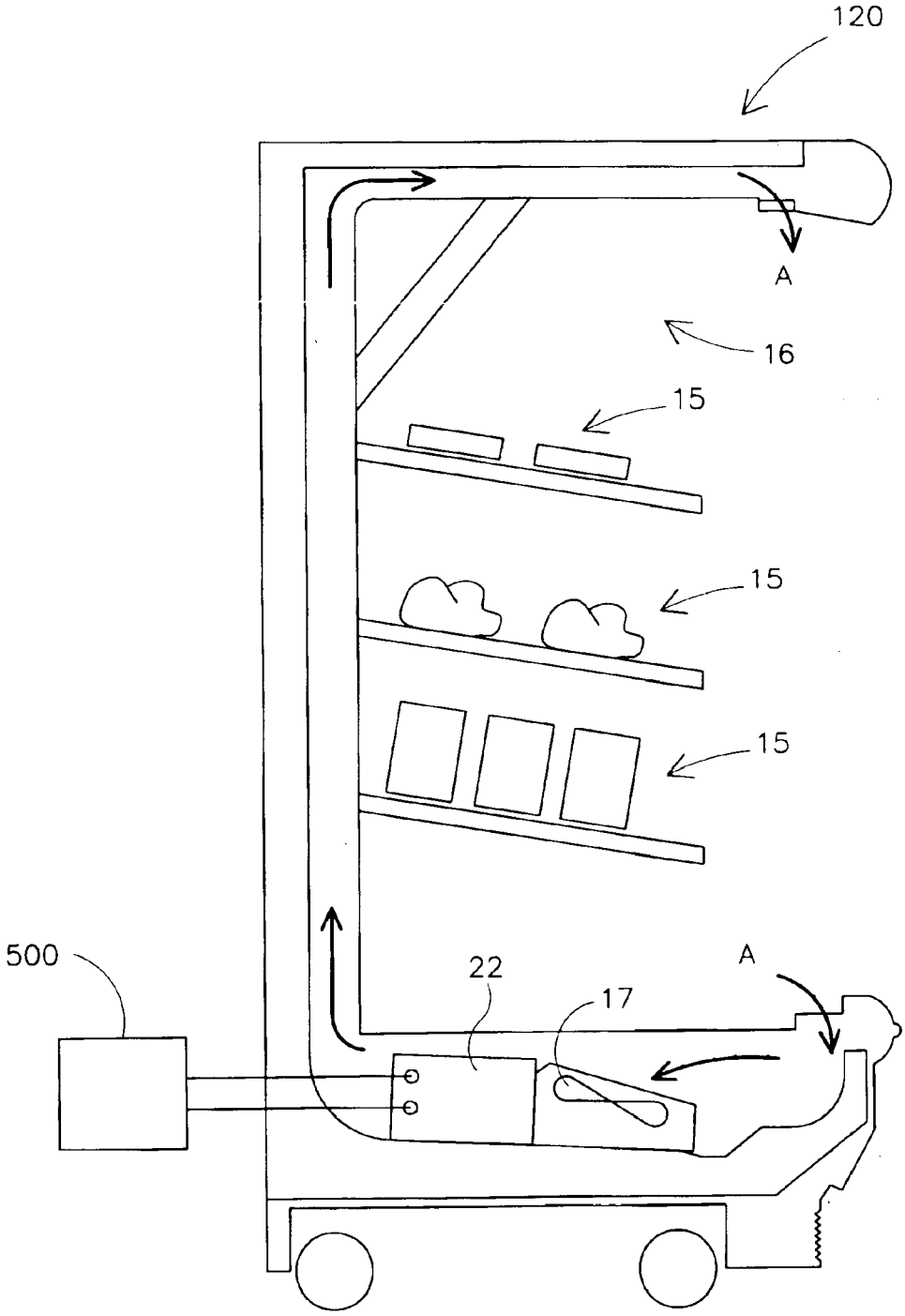
FIG. 5A is a schematic diagram of a refrigeration system with a defrost system according to an exemplary embodiment.
Figure 5B:
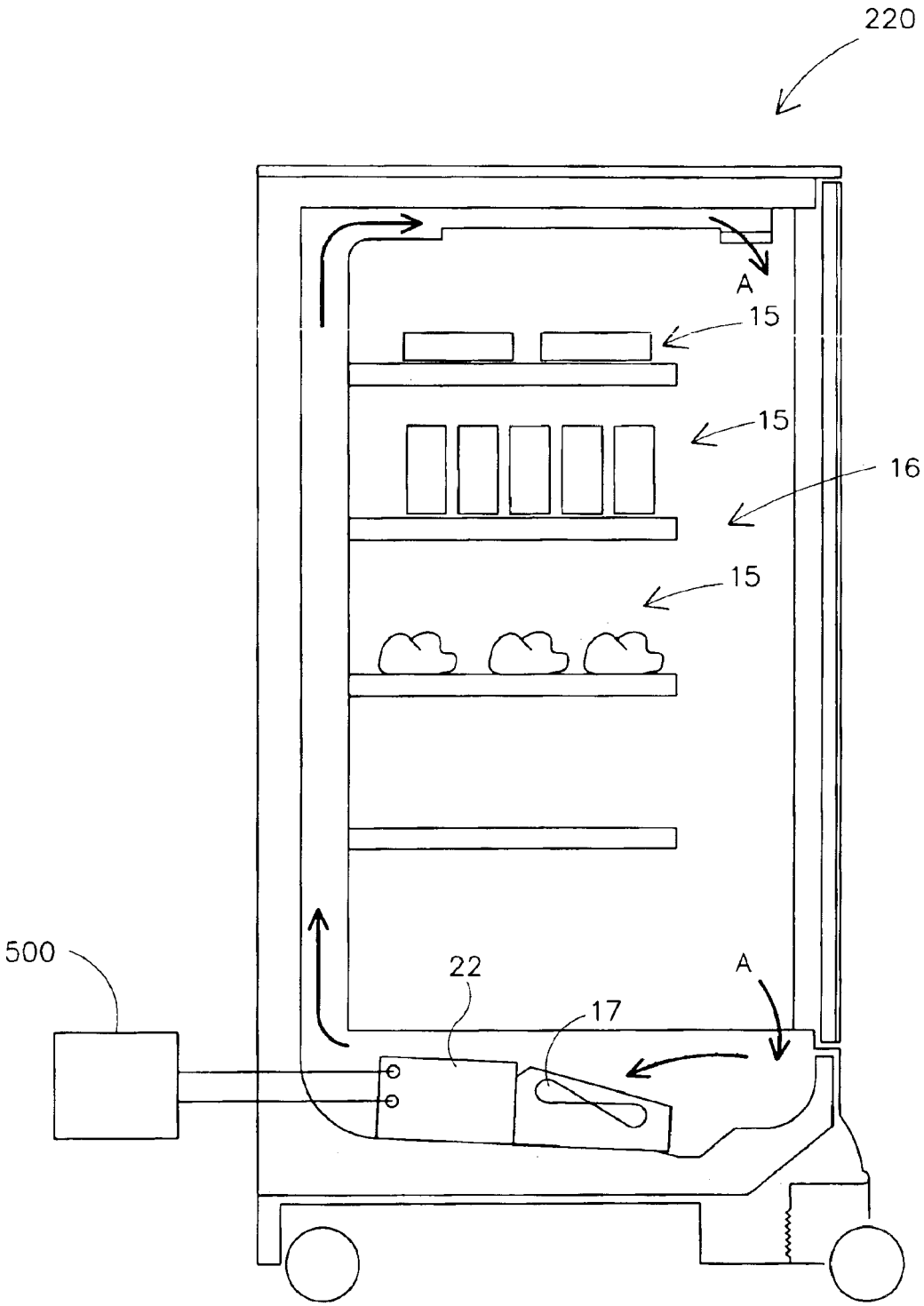
FIG. 5B is a schematic diagram of a refrigeration system with a defrost system according to an exemplary embodiment.
Figure 5C:
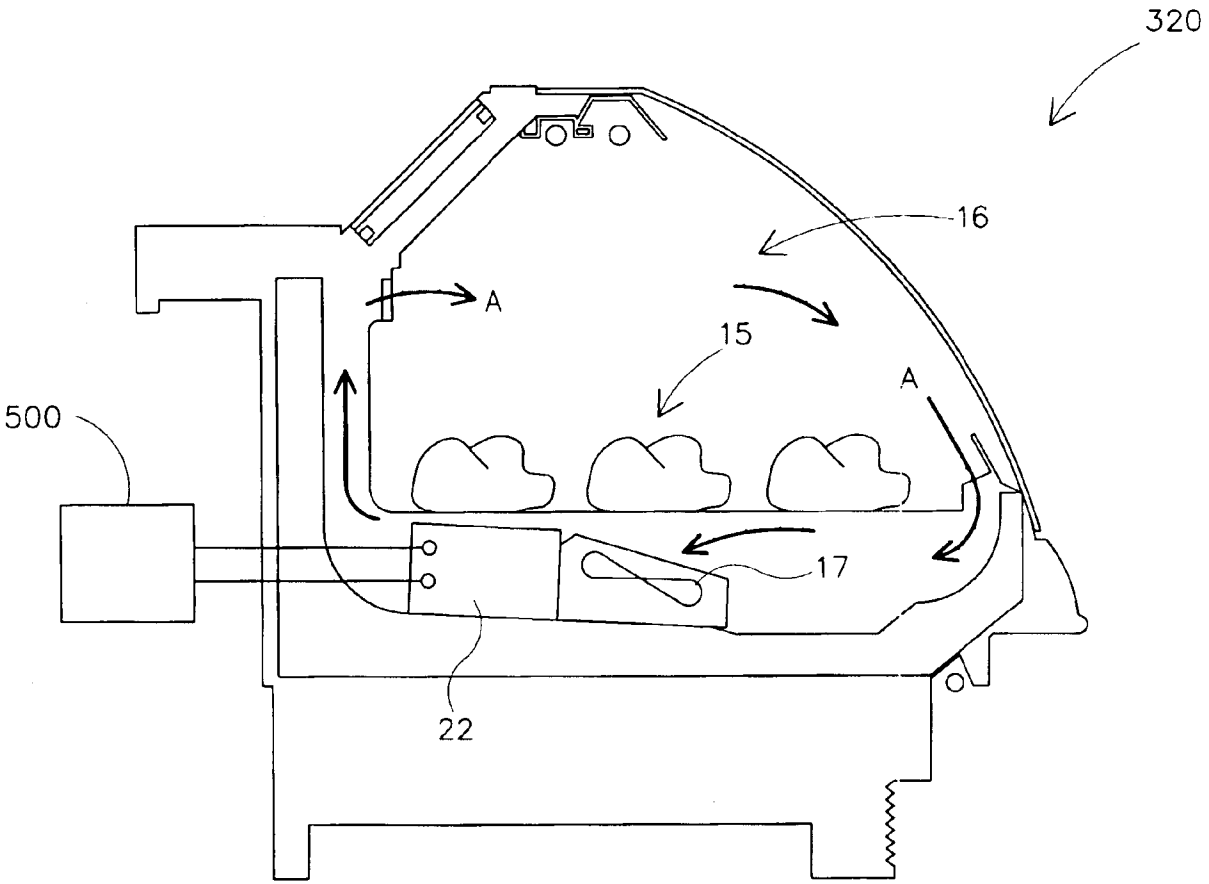
FIG. 5C is a schematic diagram of a refrigeration system with a defrost system according to an exemplary embodiment.
Figure 5D:
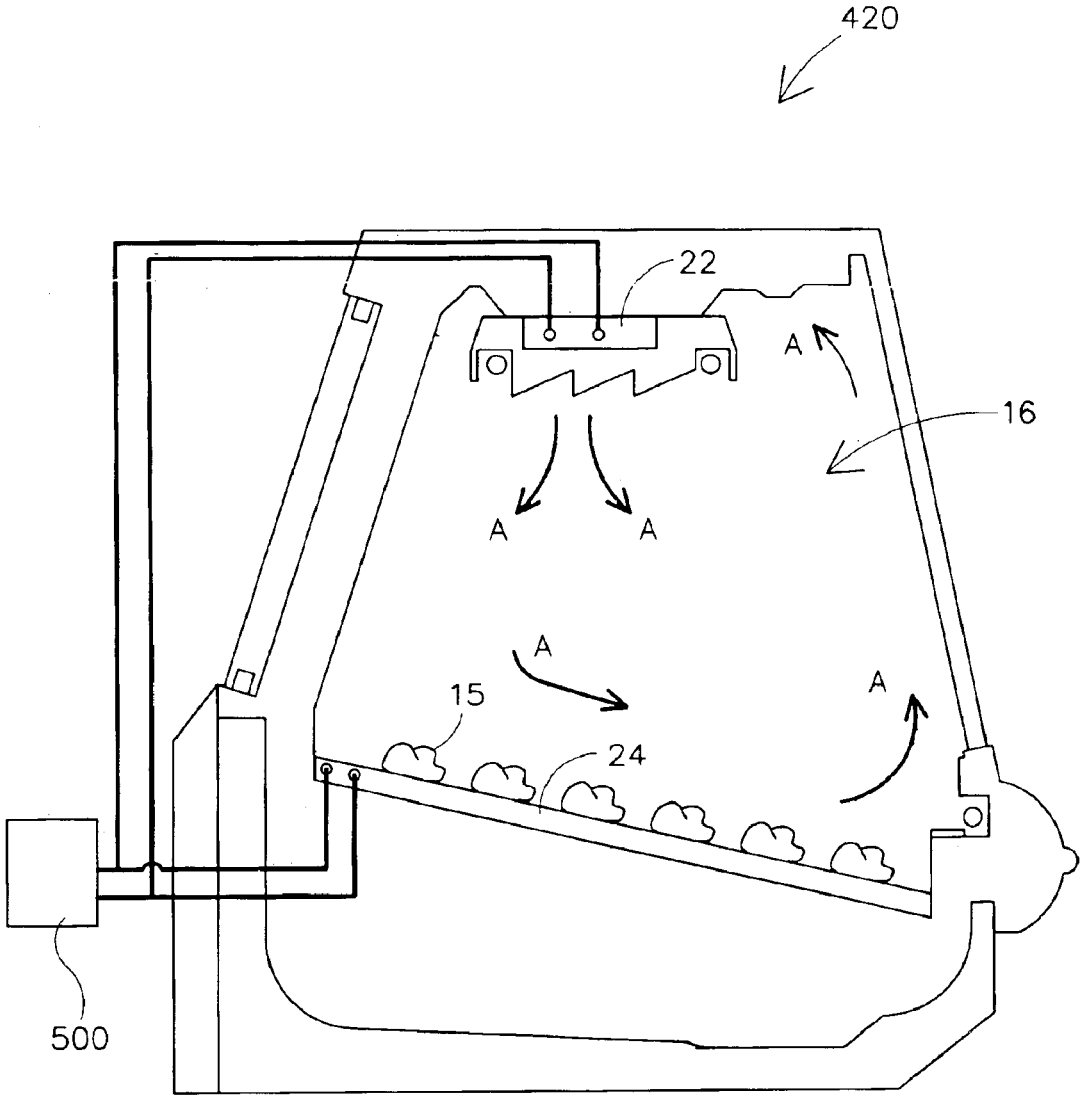
FIG. 5D is a schematic diagram of a refrigeration system with a defrost system according to an exemplary embodiment.

Referring to FIGS. 6A through 6D, defrost system 50 is shown according to a particularly preferred embodiment. As shown in FIG. 6A, defrost system 50 includes a heat exchanger 58 and a fan 55 (e.g. which may be contained in a relatively compact housing or enclosure); a cover (shown schematically as a grill or guard 53 is provided to enclose the fan 55 to prevent entry of unintended materials. Defrost system 50 also includes a set of valves 52 and 56 (which may be located within or outside of the housing or enclosure) for providing for interconnection to coolant supply line 42 to the refrigeration devices. For a service-type refrigeration device shown as a refrigerated case (see FIGS. 5C and 5D), the defrost system may be mounted in any suitable manner to one or more mounting structures (such as supports or bases or pedestals, etc.) beneath the space provided by the case (and providing a suitable supply of ambient air as shown in FIG. 6D). According to any preferred embodiment, the defrost system will be provided in a relatively compact and modular form that is suitable for convenient interconnection to the refrigeration system. It should be noted that according to various exemplary embodiments, the defrost system may be configured for interconnection to any of a wide variety of refrigeration systems and/or refrigeration devices (including the various refrigerated cases shown in FIGS. 5A through 5D as well as other types of conventional or other freezers and refrigerators used in commercial, residential and other applications).

The operating parameters and capacity of the defrost system may be adapted to the requirements of the refrigeration system. According to a particularly preferred embodiment of the defrost system, the heat exchanger is a "fan-coil" type unit having a heat transfer surface including a coil formed from copper tubing and interconnected to a series of aluminum fins and a fan configured to move air through the coil. The heat exchanger is provided in a configuration to fit within a base of the refrigeration device to minimize the need for externally routed piping or tubing. According to a particularly preferred embodiment of a type shown in FIG. 6C, the heat exchanger is provided in an enclosure or housing that has a generally rectangular shape with a height of approximately 12 inches, a length of approximately 18 inches and a depth of approximately 8 inches; the fan is driven by an electric motor (e.g. 1/15 horsepower, 2.1 full load amperes and operating on a 115 volt AC power supply); the fan (and motor) are configured to draw air through the coil portion at a suitable flow rate to provide the desired heat transfer capability (preferably while maintaining operating noise levels within acceptable ranges for use in facilities such as supermarkets, if possible).

According to a particularly preferred embodiment, the heat exchanger is of a type commonly referred to as a "unit cooler" as are typically used for refrigerating small rooms such as walk-in type coolers, etc. (According to a particularly preferred embodiment, the heat exchanger is of a "fan-coil" type commercially available from Cancoil USA, Inc. of Danville, Ill. as Model No. HFFC00101A; the valves are conventional solenoid valves suitable for refrigeration service and are of a type commercially available from Parker Hannifin Corporation of Broadview, Ill.) According to an alternative embodiment, the heat exchanger may not provide an associated fan and the coil of the unit may be sized and configured correspondingly larger to provide the necessary heat transfer capability (e.g. to allow or promote air flow, such as by gravity or natural convection). According to another alternative embodiment the heat exchanger for the defrost system may be provided in various other configurations (e.g. sizes, dimensions and shapes etc.) that are suitable to provide the desired heat transfer capability (e.g. flow rates and quantity of heat) to the coolant within the specific application or installation at any suitable location. The heat exchanger for the defrost system may include other heat transfer surfaces or other arrangements of heat transfer elements; for example, the heat transfer surface may be provided by heat transfer elements such as "microchannels" configured to provide the desired heat transfer capability within a heat exchanger having a smaller or more compact overall size and configuration for applications where less space is available or where concealment is desirable. According to other alternative embodiments of the heat exchanger for the defrost system, the heat transfer elements may provide microchannels either with or without additional heat transfer surfaces (e.g. fins, etc.). According to any alternative embodiment, heat transfer elements and/or surfaces may be selected and/or configured so that the overall size and configuration of the heat exchanger of the defrost system will satisfy performance and other physical design requirements for the refrigeration system and/or the refrigeration device.

According to a particularly preferred embodiment, in a gravity-type refrigeration device (e.g. a refrigerated case of a type as shown in FIG. 5D) with a length of eight (8) feet, defrost system 50 is configured for operation with a cooling system having a fluid flow rate (e.g. of coolant) of approximately three (3) gallons per minute (GPM) to provide a heat transfer capability of approximately 6000 BTU per hour. According to various alternative embodiments and/or other refrigeration devices having other cooling elements, the defrost system may provide other heat transfer capabilities suited for the particular type, size and nature of the refrigeration device (and/or the nature of the application, environment, or refrigerated objects), or may be configured to operate with different fluid flow rates. For example, in a gravity-type refrigeration device (e.g. a refrigerated case of a type as shown in FIG. 5D) having a length of twelve (12) feet, the fluid (coolant) flow rate is approximately 4.5 GPM. Also, in a gravity-type refrigeration device (e.g. a refrigerated case of a type as shown in FIG. 5D) having a length of sixteen (16) feet, the fluid (coolant) flow rate is approximately 6 GPM. In general, low-temperature type cases (e.g. freezers, etc.) typically require from the defrost system a higher coolant temperature, higher coolant flow rate, and/or longer defrost duration, than would otherwise be required by medium-temperature type cases (e.g. refrigerators, etc.). According to an exemplary embodiment, the coolant or supply fluid flow rate may be essentially the same in "defrost" mode or the normal operating mode (although the primary refrigeration system may be stopped during defrost mode operation to more readily facilitate the warming of the coolant in a refrigeration system configured for use with a secondary cooling system). According to other exemplary embodiments, the flow rate of the coolant may be reduced (e.g. below the normal operating flow rate by a factor of less than 1.0, such as to 0.75 or 0.5 or 0.25 or less) in the defrost mode (or increased, if necessary for suitable performance). According to a particularly preferred embodiment, in "defrost" mode operation, the flow rate of the coolant for a medium temperature case may be approximately one-half of the flow rate of the coolant for a low temperature case. According to an alternative embodiment, the flow rate of the coolant for a medium temperature case may be in a range of approximately one-quarter to three-quarters of the flow rate of the coolant for a low temperature case.

According to an exemplary embodiment, the defrost system may be configured (e.g. sized and located) to provide sufficient heat transfer capability to all or any portion of a network of circuits (e.g. flow paths having flow control elements such as valves for routing coolant to any one or more cooling elements) of the refrigeration devices in a facility. (The operating parameters and capacity of a centralized defrost system may be adapted to the requirements of the refrigeration system and/or the facility.) According to any preferred embodiment, the heat exchanger of the defrost system is sized to provide the maximum coolant temperature necessary for defrosting the largest circuit of the network within the desired defrost time period based upon the flow rates of the cooling system, and the control system is configured to provide defrosting of each or any circuit separately (e.g. selective defrosting of individual cooling elements or groups of cooling elements within a refrigeration device or case).

Figure 6F:
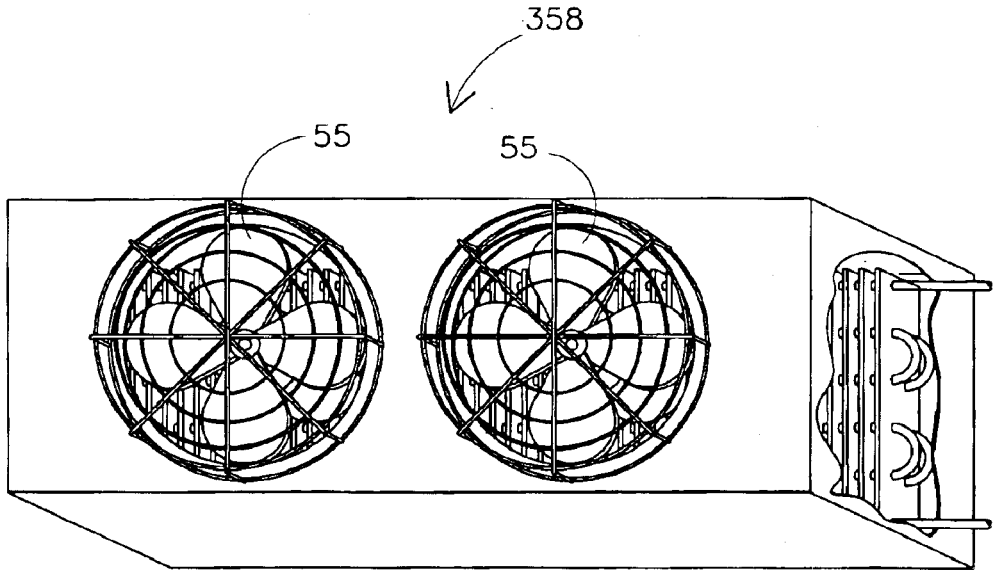
FIG. 6F is a perspective view of the defrost system of FIG. 6E.
Figure 6H:
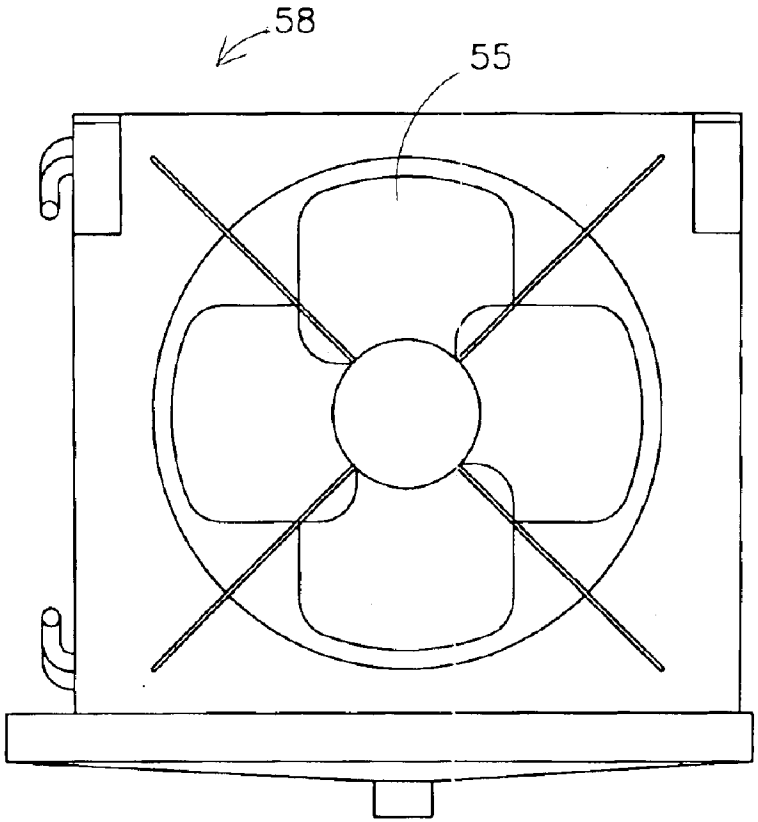
FIG. 6H is a front elevation view of the defrost system of FIG. 6G.
Figure 6G:
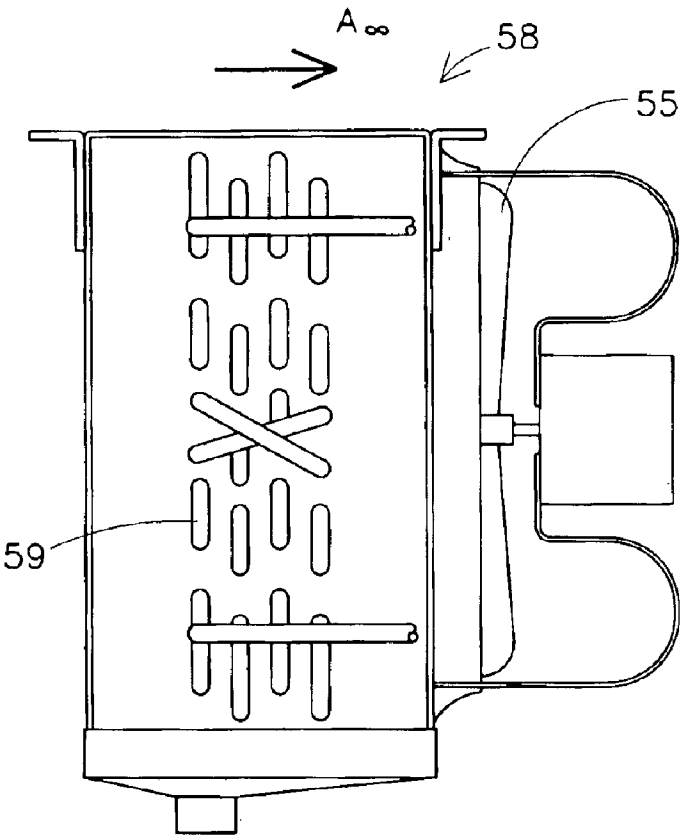
FIG. 6G is a side elevation view of a defrost system according to another preferred embodiment.

According to a particularly preferred embodiment of the defrost system shown in FIGS. 6E and 6F, heat exchanger 358 is a "fan-coil" type unit using two fans 55 to move air through the coil. According to other alternative embodiments, the heat exchanger may be configured to use additional fans or the fans may be configured for variable speed operation to provide for the defrost system the operating parameters or performance desired for the intended application.

According to any exemplary embodiment, for refrigeration systems having low-temperature type refrigeration devices (e.g. freezers, etc.) the heat exchanger of the defrost system may be supplemented with additional heating capability, such as in-line fluid heaters (e.g. immersion heating elements, external heating coils, or other suitable heating elements) provided on the coolant supply line. According to another alternative embodiment, supplemental heating capability may be provided by a heat source such as the primary refrigerant (e.g. in the appropriate state or temperature, i.e. hot gas, etc.) or other high temperature fluids that are available in the environment in which the refrigeration system is located or installed.

Figure 4:
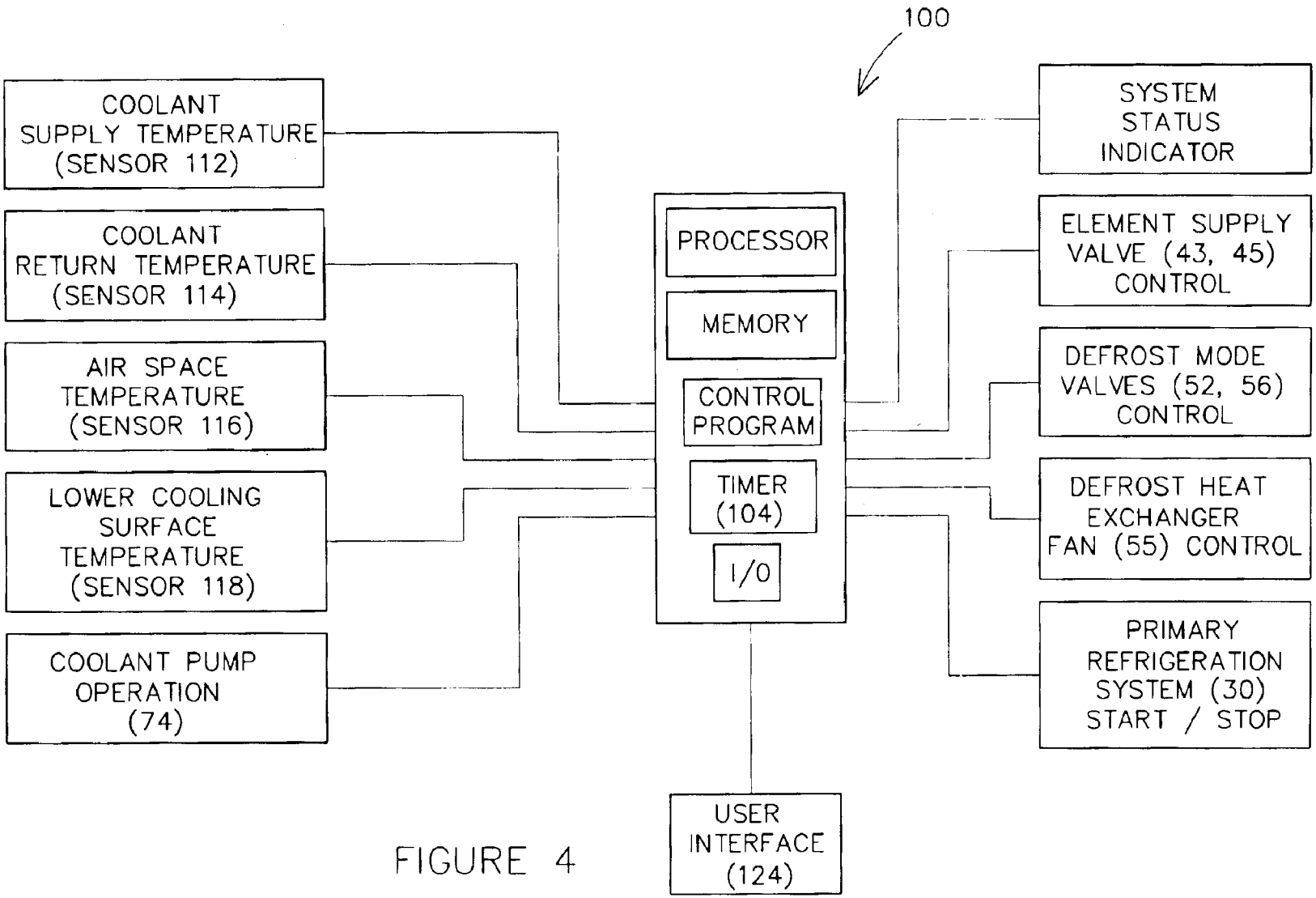
FIG. 4 is a schematic diagram of a control system for the refrigeration system according to an exemplary embodiment.

As shown in FIG. 2A, a secondary coolant system 40 provides a piping interface having flow control elements such as valves for routing coolant for the defrost system. Similar coolant piping configurations may be readily adapted for other types of refrigeration devices (such as shown schematically in FIGS. 5A through 5D). According to the embodiment of FIG. 2A, coolant supply line 42 includes a valve 52 and a defrost line 54 with an inlet valve 56. When system 10 is in the cooling mode, primary cooling system 30 operates to cool the secondary coolant and valve 52 is open and inlet valve 56 is closed to route the cooled secondary coolant (and to bypass the heat exchanger 58 of defrost system 50) directly through supply line 44 of defrost system 50. When control system 100 (as shown in FIGS. 1 and 4) activates the defrost system, the command or signal is given to close valve 52 and to open inlet valve 56 to redirect the flow of coolant to heat exchanger 58 of defrost system 50 and to transfer heat from the ambient air (or other heat source) to warm the coolant.

During the defrost mode, the control system may also determine which of the cooling elements is to be defrosted (e.g. either of cooling elements 22 or 24 separately or both cooling elements 22 and 24 simultaneously). For example, sensor 114 may provide a signal representative of the temperature of the coolant returning from the cooling elements, or sensor 116 may provide a signal representative of the air temperature within space 16, or sensor 118 may provide a signal representative of the temperature of cooling element 24, or the timer 104 of control system 100 may provide a signal representative of time for establishing a frequency for defrosting one or both of cooling elements 22 and 24. When defrosting only cooling element 22, warmed coolant is directed through supply line 44 to defrost the cooling element 22; after leaving cooling element 22, the coolant is directed through valve 45 (with valve 43 closed) to coolant return line 48. If defrosting both cooling element 22 and cooling element 24, the warmed coolant is directed through supply line 44 to defrost the surface of cooling element 22; then through valve 43 (with valve 45 closed) to cooling element 24 to defrost the surface of cooling element 24. The coolant returns through line 48 to continue circulation. As the warmed coolant flows through cooling element 22 and cooling element 24 in the defrost mode, accumulated frost and/or ice (shown schematically in FIG. 9) on the surface of the cooling devices is reduced by melting the frost and/or ice, and will drip into a drain within the refrigeration device. According to an alternative embodiment, the warmed coolant may be supplied in parallel to either one or both of the cooling elements, and may be returned in parallel to the coolant return line (as shown schematically in FIGS. 1 and 2E). When the control system determines (e.g. receives a signal indicating) that the defrost mode is completed, the primary cooling system (which was shut off during defrost mode) is restarted, inlet valve 56 is closed and valve 52 is opened to bypass that heat exchanger 58 to resume operation of the cooling mode for the refrigeration device (e.g. with refrigerated coolant supplied to the cooling elements).

Referring further to FIG. 2A, according to a particularly preferred embodiment for a refrigeration device having multiple or different cooling devices, the secondary coolant from cooling element 22 is routed through coolant return line 47, and from cooling element 24 through line 49 to a return line 48. The secondary coolant from the cooling elements is directed through a flow path or circuit that includes a balance valve 65 and an air separator 64 with an expansion tank 66 and air vent 62. The secondary coolant is directed through a strainer 70 to the suction side of a pump 78, where it is pumped through a heat exchanger (shown schematically as a chiller 32), which cools the coolant by transferring heat from the secondary coolant to a primary coolant (e.g. refrigerant, etc.). The secondary coolant is then routed to a supply line 42. In the embodiment shown, supply line 42 distributes the coolant to supply line 44 and to cooling element 22. The secondary coolant exits the cooling element 22 through return line 47 and is directed through valve 43 to supply line 46 and to cooling element 24 where it provides a cooling source for the surface of cooling element 24. The secondary coolant exiting cooling element 24 is routed through return line 49 to return line 48. According to an alternative embodiment, the secondary coolant may be supplied in parallel to the first and second cooling devices and returned in parallel to the coolant return line. The components of the secondary cooling system may generally be comprised of conventional and commercially available components. Similar piping and component configurations are adaptable to other types of refrigeration devices having secondary cooling systems, such as those shown in FIGS. 5A through 5D.

Figure 7A:
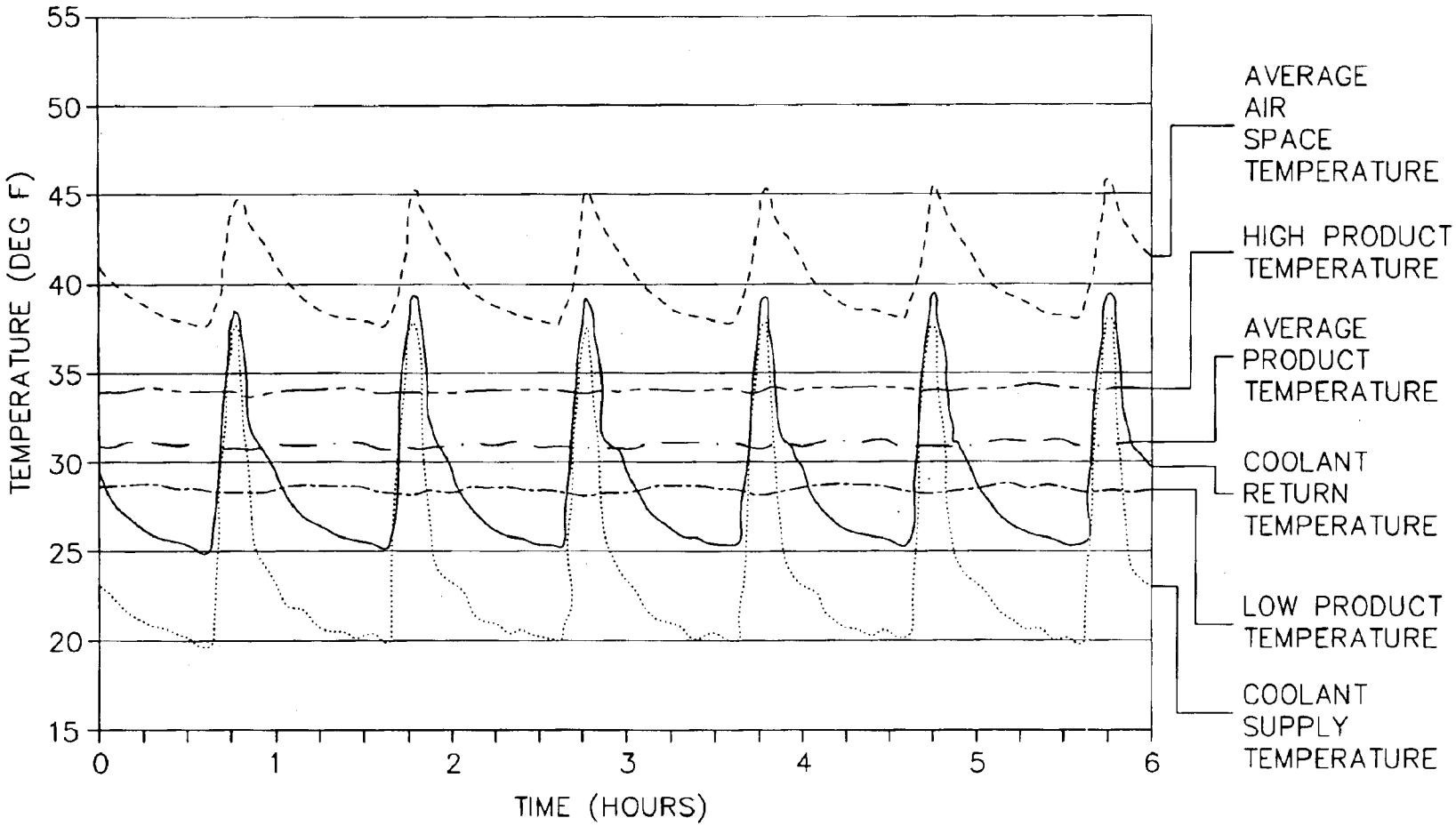
FIGS. 7A through 7D are graphical representations of parameters representative of the performance of a refrigeration device in the form of a refrigerated case (of a type shown in FIG. 5D) having a defrost system according to an exemplary embodiment.
Figure 7B:
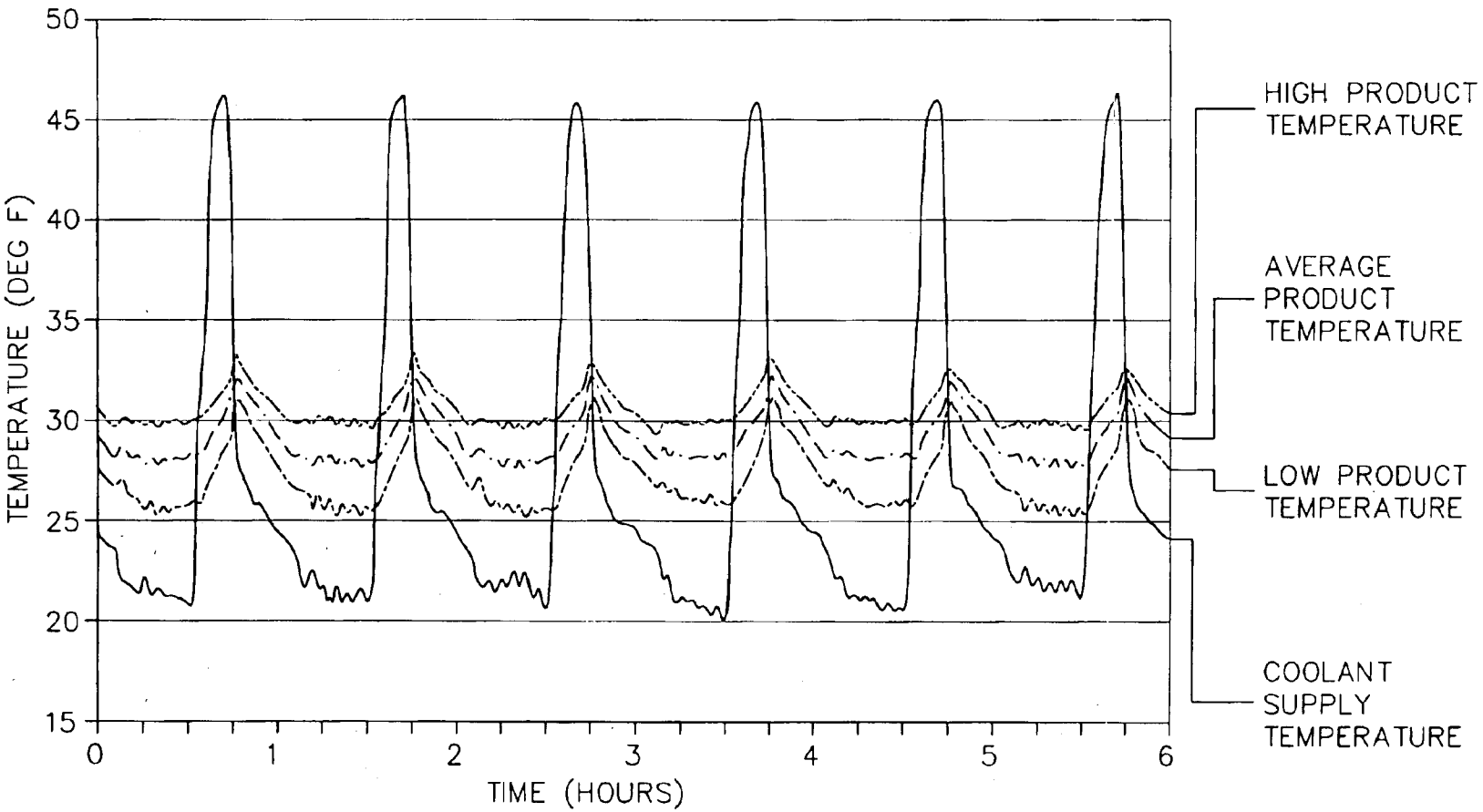
Figure 7C:
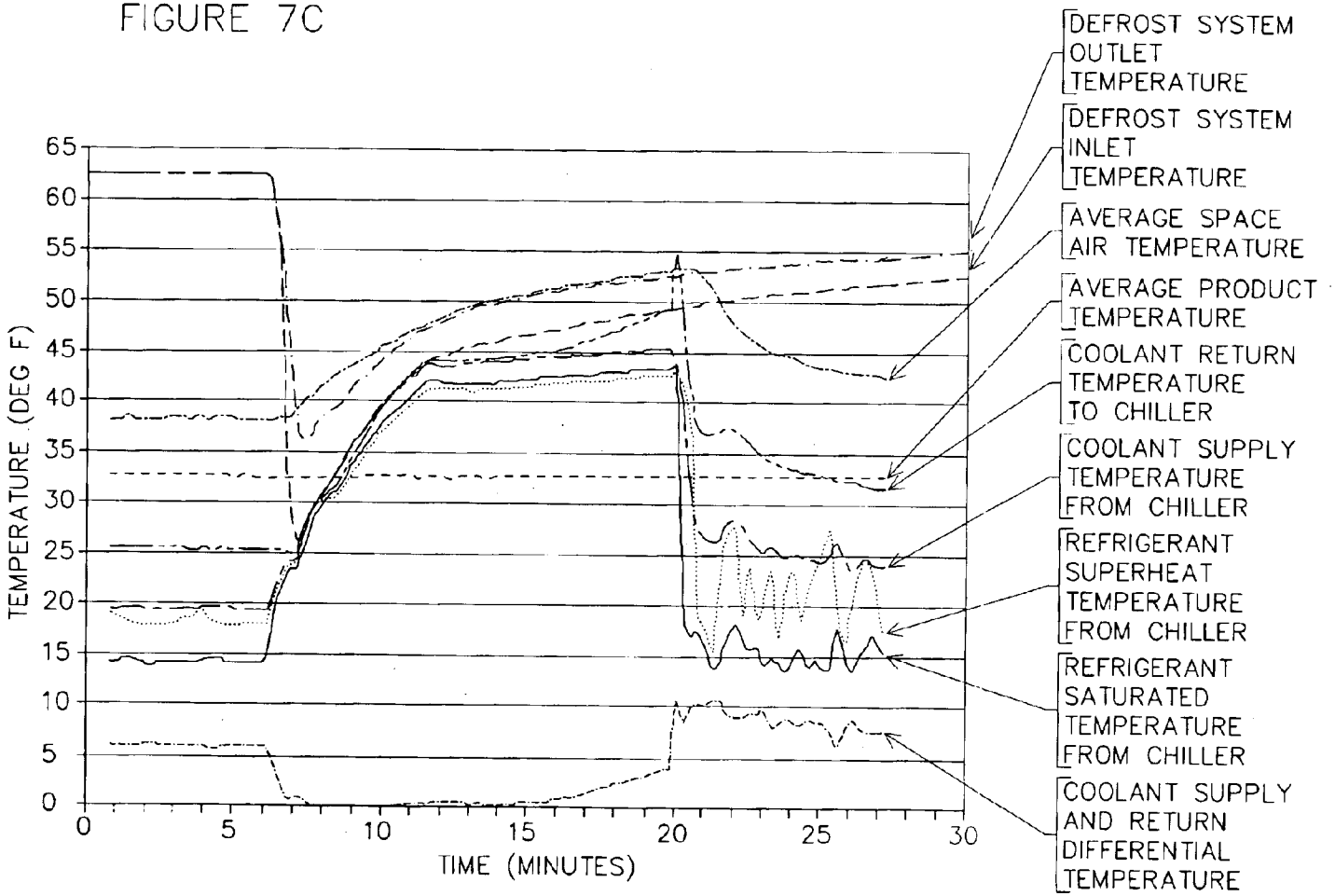
Figure 7D:
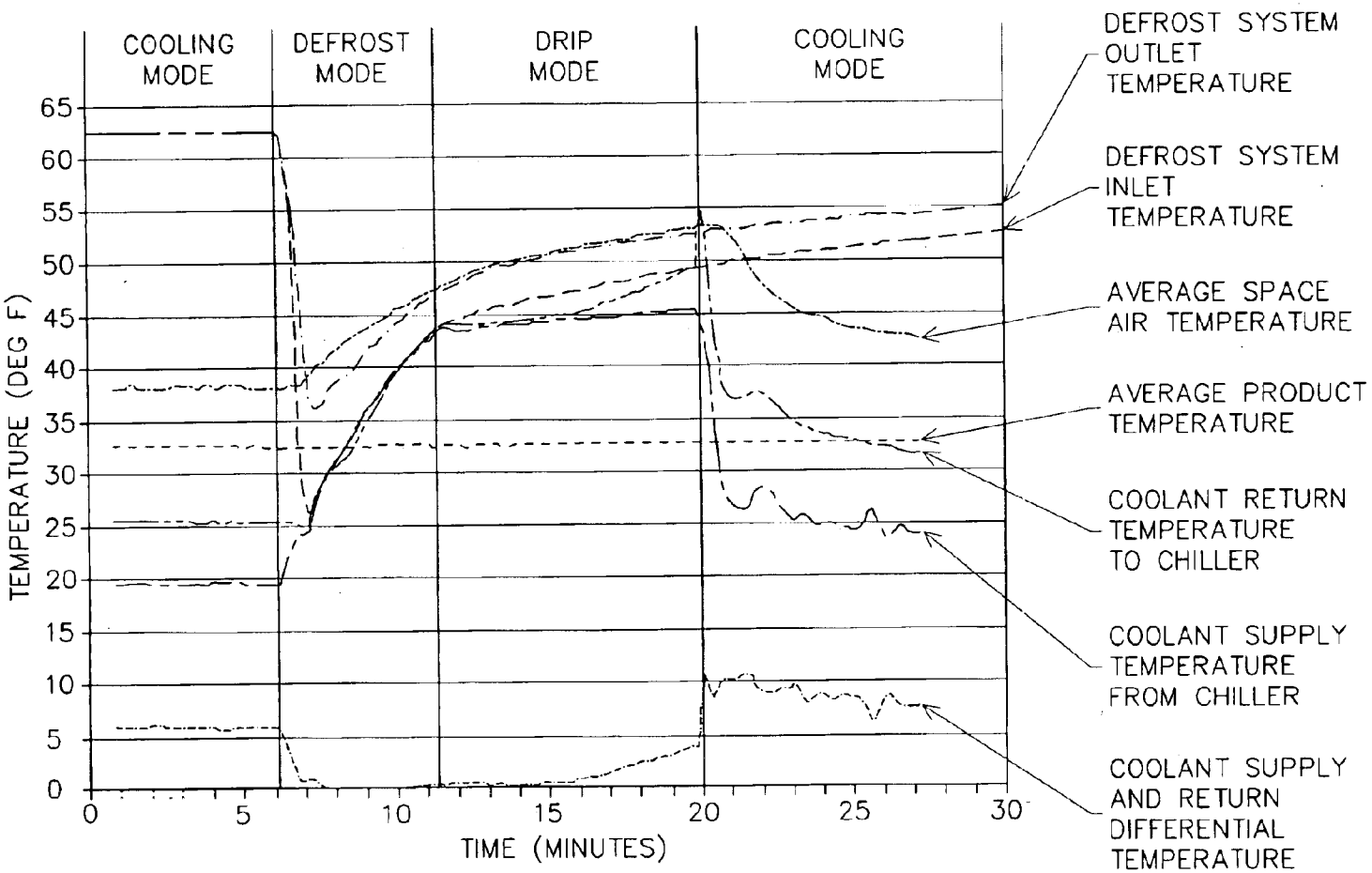

Referring to FIGS. 7C and 7D, the thermal performance and operation of a refrigeration system with a defrost system using ambient air in a defrost mode, a drip mode and a cooling mode is shown according to an exemplary embodiment for a refrigeration system having a primary coolant (e.g. refrigerant, etc.) used for cooling a secondary coolant in a heat exchanger (such as a chiller shown in FIG. 2A). FIGS. 7C and 7D are intended to be representative-of exemplary thermal performance in a refrigeration device in the form of a gravity type refrigerated case with secondary cooling (as shown for example in FIG. 5D); performance and/or operational parameters (some of which are listed in TABLE 1) may vary for other refrigeration devices based on the type of refrigeration device, as well as the type, location and number of cooling devices, objects to be cooled, etc.

TABLE 1

| TEMPERATURE | DESCRIPTION |
|---|---|
| Average space air | Calculated average air temperature from three temperature sensors within the refrigeration device adjacent a cooling element. |
| Defrost system inlet | Temperature of the coolant entering the defrost system. |
| Defrost system outlet | Temperature of the coolant leaving the defrost system. |
| Average product | Calculated average temperature from nine temperature sensors monitoring the temperature of simulated products located within the air space in the refrigeration device. |
| Coolant return (to chiller) | Temperature of coolant returning to the chiller. |
| Coolant supply (from chiller) | Temperature of the coolant leaving the chiller. |
| Refrigerant superheat (from chiller) | Temperature of the refrigerant (superheated vapor) leaving the chiller. |
| Refrigerant saturation (from chiller) | Calculated temperature corresponding to the measured pressure of the refrigerant leaving the chiller. |
| Coolant supply and return differential | Calculated difference in temperatue between the supply and return temperatures of the coolant. |

During the cooling mode prior to operation of the defrost mode, the refrigeration device is typically expected to be operating in a relatively stable condition. As shown in FIGS. 7C and 7D, the refrigerant is evaporating at a saturated suction temperature of approximately 14 deg F. with a superheat temperature of 4 deg F. as it leaves the chiller (corresponding to vapor temperature minus saturated suction temperature). The temperature of the coolant supply from the chiller is approximately 20 deg F. and the temperature of the coolant return to the chiller is approximately 25 deg F. The average temperature of the product is approximately 33 deg F., representative of a temperature that is desirable for the product. The average air temperature of the space is approximately 38 deg F., which is representative of a desirable temperature for the air space. During the cooling mode, the temperatures of the coolant in the heat exchanger of the defrost system are in a generally "no-flow" condition, as such, this portion of the coolant tends to warm to the temperature of the ambient air surrounding the heat exchanger during the cooling mode.

When the defrost mode is initiated, the cooling mode is interrupted by temporarily stopping circulation of the refrigerant to the chiller (resulting in the temperature of the coolant supply and coolant return to approach a common value as the heat transfer between the two locations is minimized). During the defrost mode, the flow of secondary coolant is diverted through the heat exchanger of the defrost system. Additionally, the fan on the heat exchanger turns on and moves air across the surface of the heat exchanger. The temperature of the coolant within the heat exchanger (e.g. retained from the last operation in defrost mode) rapidly drops from approximately ambient temperature to approximately the temperature of the coolant leaving the chiller as flow resumes. The coolant leaving the heat exchanger drops from approximately ambient temperature to a value of approximately 8 deg F. above the coolant temperature entering the heat exchanger due to heat exchanged through the heat exchanger from the ambient air as flow resumes. The temperature of the coolant (slowly) increases as the flow of coolant resumes through the heat exchanger of the defrost system (after transient conditions are overcome through the system).

According to an exemplary embodiment, the defrost mode is terminated when the temperature of coolant leaving the cooling elements reaches approximately 45 deg F. (i.e. based on a determination through empirical testing that when the temperature of the coolant leaving the cooling element is approximately 45 deg F., a sufficient amount of defrosting has occurred to remove the layer of frost or ice that would typically have formed on the surfaces of the cooling element). According to an exemplary embodiment for a refrigeration device (of a type shown in FIG. 5D), the duration of time for the defrost mode is approximately 5 minutes (as shown in FIGS. 7C and 7D). Following completion of the defrost mode, the fan of the defrost system is turned off and the coolant flow within the secondary system is temporarily stopped to begin a "drip" mode. During the specified time period that coolant flow is stopped, (the "drip" mode) remaining moisture on the surface of the cooling element is expected to drip into a drain or to evaporate. According to the exemplary embodiment shown, the duration of the time period for the drip mode is approximately 8 minutes. During the drip mode, the coolant is not flowing through the heat exchanger and the temperature of the coolant entering and the temperature of the coolant leaving the heat exchanger begin warming to a temperature value of approximately the temperature of the ambient air adjacent the heat exchanger.

When "drip mode" is completed, the cooling mode is resumed; the flow of secondary coolant resumes in a flow path that bypasses the defrost system, and the flow of refrigerant to the chiller resumes. The difference in temperature between the temperature of the coolant return to the chiller and coolant supply from the chiller is higher following restart of the cooling mode (approximately 10 deg F.) as the chiller returns the temperature of the coolant to the temperature required by the cooling mode following the defrost mode (typical of most refrigeration devices). The temperature of the superheated refrigerant vapor in the primary cooling system leaving the chiller varies (e.g. "hunts" or cycles, etc.) within a range of (e.g. approximately 2 to 14 deg F.), indicating adjustment of the primary cooling system in response to the changed thermal loading following restart of the cooling mode (e.g. the amplitude of this cycling decreases until a relatively stable equilibrium is reached, similar to that seen prior to the start of the defrost mode). The temperatures,of the coolant supply from the chiller and coolant return to the chiller slowly decrease toward the temperatures required by the cooling mode. As shown in FIG. 7C and 7D (and according to any preferred embodiment), during the defrost mode, the average temperature of the product during the defrost mode remains relatively constant. According to alternative embodiments, the relationship of the temperatures may change within any suitable range to reflect the desired characteristics of the refrigeration device (e.g. low temperature or medium temperature applications, the nature and type of cooling devices, the type and capacity of the chiller and the heat exchanger, configuration of the refrigeration system with a single cooling system or a combined primary cooling system and secondary cooling system, ambient air temperature, flow rates of the coolant, etc.).

The cooling elements for providing cooling in the cooling devices may be provided as any suitable element for transferring heat from the space to be cooled to the coolant. For example, referring to FIGS. 5A through 5D, the cooling elements may have various configurations (e.g. gravity coil, forced-air coil, tray, pan, shelf, etc.) that may be provided in the space or integrated into the base or other suitable location within the refrigeration device. According to an alternative embodiment, one or more cooling elements may be configured in a horizontal or vertical alignment or array or other arrangement according to the desired size, shape, storage and display requirements of the refrigeration system. According to another alternative embodiment, the refrigeration device may provide a cooling element in an upper portion of the space to provide a gravity cooling of warmer air that has risen to an upper portion within the space inside of the refrigeration device; the cooled air in contact with the cooling element then descends downward over articles or objects to be cooled that may be stored or displayed within the space; the refrigeration device may also provide a cooling element with a surface below on which objects are placed.

One embodiment of a cooling element 22 (shown schematically in FIGS. 8A, 8B and 9) includes a multitude of elongated channels having a narrow rectangular cross section defining a series of internal passages 91 for flow of the coolant. According to a particularly preferred embodiment, the channel arrangement may be a grouping of channels having rectangular cross section, such as, for example, a type known as "microchannels" and commercially available from Modine Manufacturing Company of Racine, Wis. The channels provide a surface configuration that may be defrosted more rapidly than conventional tube-and-fin heat exchange devices or coils. As shown in FIG. 2, the channels are oriented with their long sides 90 in a substantially vertical orientation to promote gravity-induced convection heat transfer with the air in space 16 and have a supply header or manifold 84 at a supply end for directing the coolant into the channels, and a return header or manifold 80 at a return end to collect or receive the coolant from the channels. According to an alternative embodiment, the channels may have a plurality of interconnecting projections (shown schematically in FIG. 9 as fins 96), or the surface of the cooling element may be a coil or other configuration of tubes or conduits having various shapes and dimensions with or without a multitude of fins or other structure for transferring heat from the space to be cooled to the coolant.

Figure 8A:
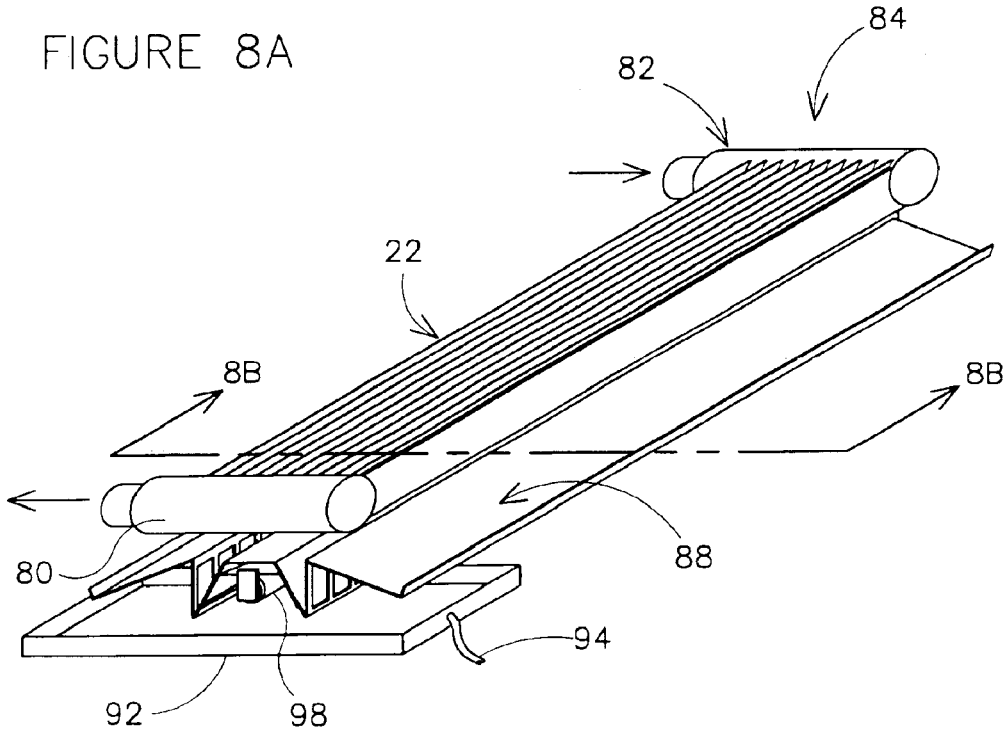
FIG. 8A is a perspective view of cooling elements for a refrigeration system according to an exemplary embodiment.
Figure 8B:
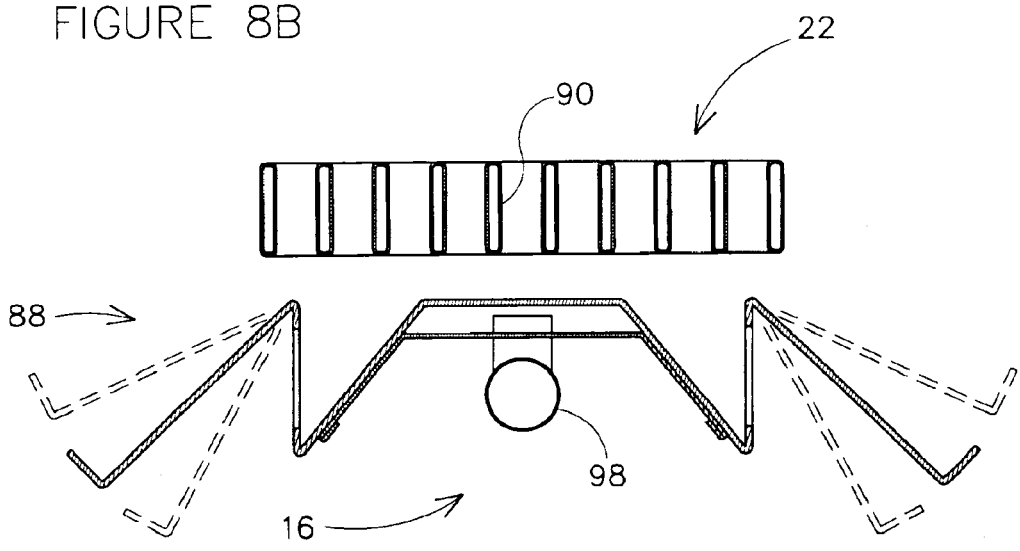
FIG. 8B is a cross-sectional view of the cooling elements along line 8B—8B of FIG. 8A according to an exemplary embodiment.

Referring further to FIGS. 8A and 8B, a device shown schematically as a louver 88 may be provided generally beneath cooling element 22 to collect water that drips from cooling element 22 during the defrosting mode for drainage to a collector (shown schematically as a drain pan 92) and through a drain line 94 to a suitable drain (not shown). The presence of the water generated during the defrost mode from melting the accumulation of frost or ice provides a source of moisture within space 16 through evaporation to help maintain a desirable humidity level within space 16. In a particularly preferred embodiment, louver 88 may also be configured in one or more positions (as shown schematically in FIG. 8B) to accommodate various shapes and sizes of space 16 to enhance the flow or distribution of cooled air from cooling element 22 during the cooling mode. Louver 88 is also provided with a lighting device or fixture 98 to illuminate and enhance the visibility of objects stored or displayed within space 16.

Figure 3:
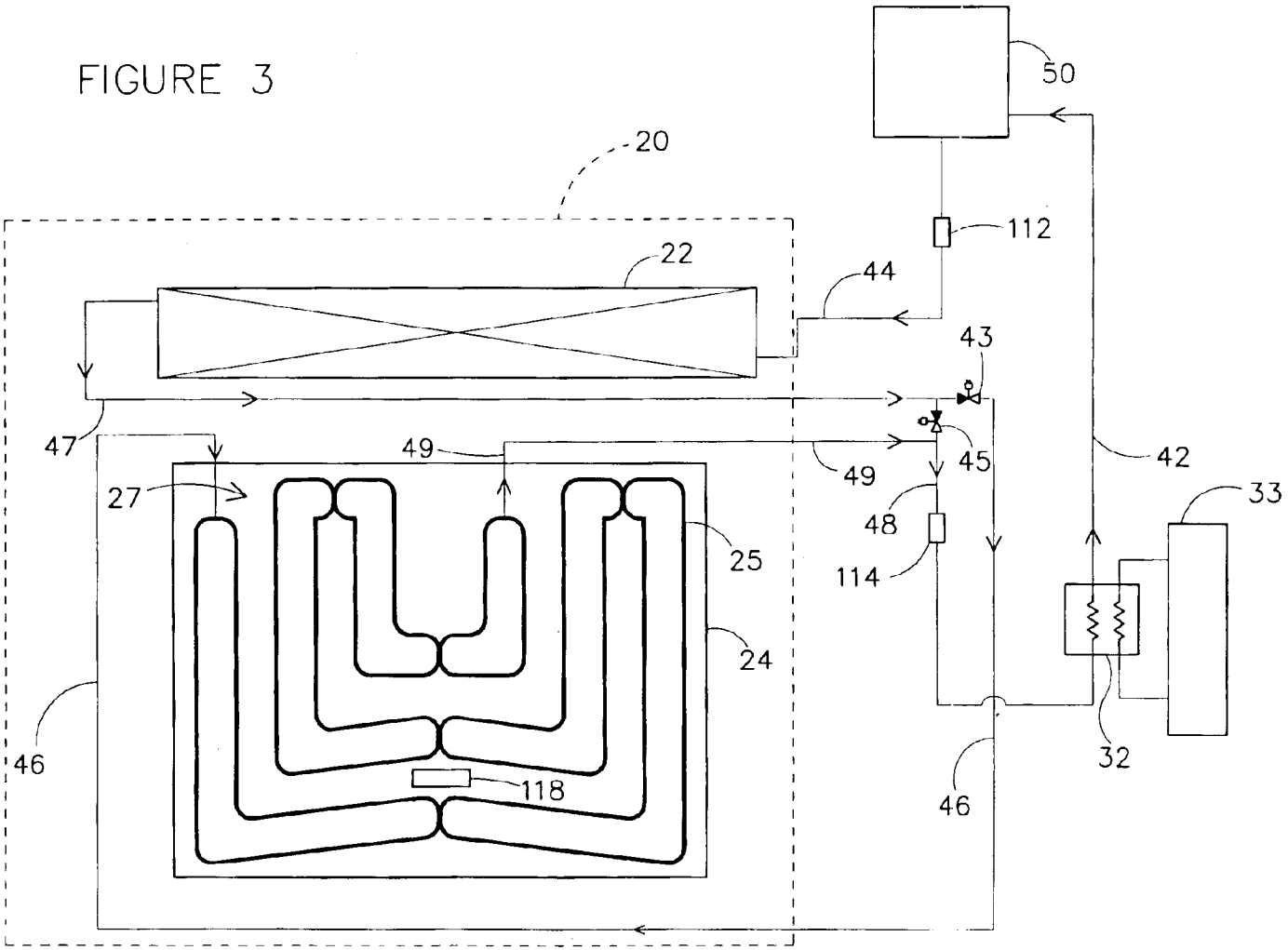
FIG. 3 is a schematic diagram of cooling elements for a refrigeration system with a defrost system according to an exemplary embodiment.

Referring to FIG. 3, an exemplary embodiment of a cooling element 24 is shown for a gravity-type refrigeration device. Cooling element 24 is shown as a relatively flat panel oriented at a downward angle (shown schematically in FIG. 5D) toward a front portion of space 16 to improve the visibility of objects provided on cooling element 24 and to create a slope that helps induce an air circulation pattern. According to a preferred embodiment, the slope of cooling element 24 creates an air circulation pattern where the cooled air flows downward from cooling element 22, over cooling device 24 and toward the lower front of space 16, while the air toward the front of space 16 that is warmed by the outside ambient air rises toward cooling element 22 to create a circulation pattern (e.g. as would provide a circulation of cooled air in a closed type refrigeration device or an air "curtain" in an open type refrigeration device according to an exemplary embodiment). The circulation pattern is intended to reduce the rate at which moisture from open or uncovered food products such as dairy, deli and meat products, or other moisture-containing objects, is transferred to the air and helps to retain the appearance, quality and marketability of such objects while stored or displayed within the space while reducing the need for adding moisture to the space to otherwise maintain product appearance (and consequentially increasing the frost accumulation rate on the surfaces of the cooling elements). Cooling element 24 provides both a source of cooling and a platform for the display and storage of objects within space 16. In order to accomplish both the cooling and display functions, cooling element 24 is formed in a substantially planar shape, having a pattern of internal passages (shown schematically in an exemplary embodiment in FIG. 3) formed within for transporting the coolant through cooling element 24 for supporting and cooling objects that are stored or displayed. According to a preferred embodiment, cooling element 24 is integrated into the lower portion of the cooling device. According to an alternative embodiment, the cooling element may be configured as a removable element (e.g. for cleaning, etc.). According to another alternative embodiment, fans or blowers may be provided to enhance the circulation within the space and misters or other moisture-adding devices may be provided to reduce dehydration or drying-out of objects.

Referring further to FIG. 3, a cooling element 24 having cooling passages is shown according to an exemplary embodiment. Cooling element 24 is preferably made of sheet metal or aluminum and includes passages 25. According to a particularly preferred embodiment, passages 25 are interconnected in a configuration that provides a coolant distribution pattern 27 that results in a substantially uniform temperature distribution over the cooling element 24 and having an inlet connected to supply line 46 and outlet connected to return line 49. According to an alternative embodiment, the cooling element may have various shapes and sizes and may have other coolant patterns or passages suited for maximizing the heat transfer from objects on the cooling element to the coolant, or for maximizing the rate at which the panels are defrosted during the defrost mode. According to another alternative embodiment, the cooling elements may be provided with other coolant distribution patterns or provided without cooling capability.

A control system 100 for refrigeration system 10 having a defrost system 50 is shown according to an exemplary embodiment in FIG. 4. Control system 100 is adapted to receive various input signals (e.g. from sensors associated with the refrigerated case, defrost system, etc.) and to provide various output and control signals (e.g. for fans, valves, switches and other devices). In a particularly preferred embodiment, control system 100 is adapted to interface with sensors that provide signals representative of the temperatures of the coolant supply to the cooling elements, coolant return from the cooling elements, air space, the surfaces of the cooling elements, and indicators and switches representative of refrigeration system or defrost system operation. Control system 100 includes a control program and/or timer as well as memory; the control program may be implemented in any combination of hardware and software. Control system 100 also provides a user interface to provide status and other information (e.g. indicators or alarms or the like) to allow monitoring and/or control and adjustment of the operation of the refrigeration system and the defrost system. The user interface provides capability for the control system to be monitored and operational parameters (e.g. set points, temperature ranges, flow rates, defrosting durations, etc.) to be set or adjusted for the particular requirements of the refrigeration device and defrost system based on application-specific factors or such variable factors as seasonal air temperature and humidity changes, operating condition changes, changes in product loading requirements, operation of the refrigeration device as a separate unit or as one of multiple networked units, changes in coolant types or flow rates, objects (nature, type, quantity, mass or composition), etc.

According to a preferred embodiment, the control system includes a memory module and a programmable microprocessor-based device that may be programmed by a user to interact with the various sensors, input and change set points, establish or modify defrost times, vary other operational parameters, etc. According to a particularly preferred embodiment, the control system employs a programmable microprocessor-based device is of a type commercially available from Danfoss Inc. of Baltimore, Md., and marketed under the trade name "Degree Master" by Hill PHOENIX of Conyers, Ga. According to other alternative embodiments, any of a wide variety of other control systems and/or controllers suitable for the application and environment could be used to regulate the operation of the refrigeration device and/or the defrost system.

Referring further to FIGS. 1 and 4, a control system 100 is shown schematically for controlling the operation of system 10 in the cooling mode and in the defrost mode according to a preferred embodiment. The particular elements and configuration of control system 100 may be adapted to suit the type of refrigeration device (as shown for example in FIGS. 5A through 5D) and the configuration of the defrost system (as shown for example in FIGS. 2A through 2E). Control system 100 (shown according to an exemplary embodiment intended for use with a refrigeration device of the type shown in FIG. 2A but readily adapted for use with other refrigeration devices and equipment configurations) includes a controller or control device 102 such as a microprocessor having a timing function preferably located at (or on) system 10 and having sensors for monitoring parameters of system 10. The control system 100 receives input signals from the control sensors and provides output signals to control the operation of system 10. A coolant supply sensor 112 monitors parameters (e.g. temperature, etc.) of the coolant at a location preferably downstream from defrost heat exchanger 58 for the coolant during the cooling mode and the defrost mode. A coolant return sensor 114 monitors and provides a signal representative of the temperature of the coolant exiting the cooling element 22 and exiting the cooling element 24. An air space sensor 116 is provided within space 16 for monitoring and providing a signal representative of air temperature within space 16. A cooling element sensor 118 is provided for monitoring and providing a signal representative of the temperature of cooling element 24, and used by control system 100 for providing a signal for operating valves 45 and 43 (as shown schematically in FIG. 2A) to regulate the flow of coolant to cooling element 24 to maintain the temperature of cooling element 24 within a range that is compatible with the temperature requirements of objects stored or displayed on cooling element 24.

According to alternative embodiments, other sensors and/or combinations of sensors may be installed within the refrigeration devices, defrost system, or otherwise within the refrigeration system to obtain information that can be used in the monitoring, operation or adjustment of the cooling system and defrost system; the control system may control one or more individual systems or devices of the refrigeration system; additional or multiple control systems may be used (separately and/or networked in various combinations to share data and/or operational parameters or control criteria).

Referring further to FIGS. 2A and 4, in a gravity type refrigeration device, valves 45 and 43 are controlled by control system 100 to regulate the flow of coolant to cooling element 24 in a manner that maintains the temperature of the cooling element within a range that provides an appropriate amount of cooling while preventing refrigerated objects stored or displayed on second cooling element 24 from freezing. When system 10 is in the cooling mode and control system 100 indicates that cooling of cooling element 24 is required, or when system 10 is in the defrost mode and control system 100 indicates that defrosting of cooling element 24 is required, valve 45 closes and valve 43 opens to provide cooling element 24 with a supply of coolant through line 46. When system 10 is in the cooling mode and control system 100 receives a signal indicating that cooling of cooling element 24 is not required, or when system 10 is in the defrost mode and control system 100 receives a signal indicating that defrosting of cooling element 24 is not required, valve 45 opens and valve 43 closes to route the coolant from cooling element 22 directly to return line 48.

Referring further to FIGS. 2A and 4, a sensor 74 (e.g. shown as a current sensing relay or switch), monitors the electrical characteristics of pump 78 (e.g. current, etc.) and provides a signal to control system 100 when the electrical characteristics of pump 78 are not within a predetermined range and may be indicative of abnormal operating conditions. Control system 100 is configured to provide an indication (e.g. alarm, etc.) when the electrical characteristics of the pump are not within a predetermined range indicating that secondary cooling system parameters may not meet pre-established operating or performance criteria.

Referring to FIGS. 4, 7A and 7B, a defrost system timing interface for system 10 is shown according to a preferred embodiment. Control device 102 is described in reference to the gravity-type refrigeration device and may be adapted to other types of refrigeration devices and includes, or communicates with, a timing function or a timer 104 to initiate the defrost mode and to stop or interrupt the operation of the primary refrigeration system at periodic intervals. Timer 104 provides a signal to control system 100, which provides a signal to change the position of valve 52 and inlet valve 56 from open to closed, and closed to open, at an adjustable frequency to alternate the operation of the refrigeration system between the cooling mode and the defrost mode. A signal frequency or duty cycle for timer 104 is established empirically to initiate the defrost mode (a representative output from operation of the defrost system on a periodic frequency is shown in each of FIGS. 7A and 7B). A duty cycle or period for timer 104 is established to provide frequent initiation of the defrost mode for a short time duration to eliminate and/or maintain the frost layer on the surface of the cooling elements at a minimal thickness and prevent excessive frost buildup. According to any preferred embodiment, periodic initiation of the defrost mode at a suitable frequency (and at a suitable temperature for a suitable duration) will maintain the surfaces of the cooling elements in a generally (or particularly) frost-free condition insofar as the frost is not permitted to accumulate to the extent that there is any substantial effect or temperature variation of objects stored or displayed in the space. The operating parameters (e.g. duty cycle, etc.) for a particular refrigeration device is established empirically by testing to determine appropriate set points for maintaining object (e.g. product) temperature variation within accepted quality standards. According to a particularly preferred embodiment, a refrigeration device (of a type shown in FIG. 5D) with a gravity-type cooling element (e.g. a cooling element 22 having a microchannel cooling surface as shown schematically in FIG. 9) would initiate the defrost mode of operation for the cooling element at approximately one hour intervals (i.e. 24 times per day); a cooling element 24 (shown schematically as a pan or panel in FIG. 3) would initiate the defrost mode at approximately 12 hour intervals (i.e. twice per day). The defrost frequency for other types of refrigeration devices and/or other types of cooling elements may be set or determined on a separate frequency suited to the characteristics of the cooling elements (e.g. the likelihood of frost accumulation, such as in narrow gaps or spacing between surfaces) and the potential for the cooling surface to accumulate frost (e.g. based on the environment and objects (and factors such as humidity)).

Different types of cooling elements (such as a gravity coil, a panel, finned surfaces and non-finned surfaces) typically provide different defrosting time and/or temperature requirements based on the rate at which the surfaces of the cooling elements accumulate frost. Such different types of cooling elements may be included in the same refrigeration device and the control system is configured to control defrost operation of each cooling element separately or in combination. According to any exemplary embodiment, the exact frequency (or duty cycle for the defrost mode) is established empirically to determine the optimum frequency for a particular refrigeration system based on such factors, among others, as the range of temperature within which the objects must be maintained, the desired temperature of the space, the nature of the objects being stored or displayed, the humidity level, the temperature of the heat source associated with the defrost heat exchanger, the characteristics of the coolant, and other parameters relevant to the performance of the system.

In any exemplary embodiment, the frequency of defrost mode initiation and the duration of the defrost mode may be developed to suit the particular refrigeration device and intended service applications. For example, open-type cases (e.g. "reach-in" cases using an air curtain across the case opening but no physical barrier or door, etc.) that are more readily exposed to the humidity conditions of the surrounding air may be defrosted four times per day for a duration of 10 to 30 minutes. Closed-type cases (e.g. "reach-in cases" such as freezers having a door, etc.) that have limited exposure to the humidity in surrounding air may be defrosted once per day for a duration of 10 to 30 minutes. Control of the frequency and duration of defrosting may also be affected by seasonal or climatic conditions such as summer in contrast to winter (i.e. when the temperature and humidity conditions may differ substantially); the appropriate frequency and duration of the defrost mode may also be affected by geographical location of the refrigeration device. For example, applications in warm (e.g. tropical) locations may require more frequent defrosting than applications in locations having cooler and dryer climates.

According to an exemplary embodiment, FIGS. 7A and 7B are representative of the performance of a refrigeration device (in the form of a refrigerated case of a type, shown in FIG. 5D). As shown in FIGS. 7A and 7B (and TABLES 2 and 3), the defrost system is intended to provide relatively stable thermal performance and relatively tight controllability of temperatures. According to a particularly preferred embodiment, the defrost system is configured to operate according to a predetermined schedule (e.g. for approximately 3 to 5 minutes every hour) to prevent the accumulation of ice and frost on the surfaces of the cooling elements within the space. Following operation of the defrost system, the control system may be configured to provide a drip mode having a time period of several minutes (shown for example in FIGS. 7C and 7D as approximately 8 minutes) between stopping the flow of warmed coolant in the defrost mode and restarting the flow of cooled coolant in the cooling mode to allow remaining moisture on the cooling surface to be removed (e.g. drip or evaporate, etc.) from the surface of the cooling element before the cooling mode is resumed.

TABLE 2

| TEMPERATURE | DESCRIPTION |
|---|---|
| Average space air | Calculated average, air temperature within the refrigerated case adjacent a cooling element. |
| Average product | Calculated average temperature for simulated products located within the space. |

TABLE 2-continued

| TEMPERATURE | DESCRIPTION |
|---|---|
| High product temperature | Indicates a maximum value of temperature for simulated products located in the space to be cooled. |
| Low product temperature | Indicates a minimum value of temperature for simulated products located in the space to be cooled. |
| Coolant return temperature | Indicates a value of the temperature of the coolant leaving the cooling element. |
| Coolant supply temperature | Indicates a value of the temperature of the coolant supplied to the cooling element. |

TABLE 3

| TEMPERATURE | DESCRIPTION |
|---|---|
| High product temperature | Indicates a maximum value of temperature for simulated products located in the space. |
| Low product temperature | Indicates a minimum value of temperature for simulated products located in the space. |
| Average product | Calculated average temperature for simulated products within the space. |
| Coolant supply temperature | Indicates a value of the temperature of the coolant supplied to the cooling element. |

Referring further to FIGS. 7A and 7B, according to an exemplary embodiment, in normal operation, the coolant (shown as secondary coolant) is supplied to the cooling elements within the refrigeration device at approximately 20 deg F. and returned at approximately 25 deg F. During the operation of the defrost system, ambient air (typically in a temperature range from approximately 70 deg F. to 75 deg F.) is drawn through the defrost system (e.g. by the fan); the coolant is routed through the heat exchanger of the defrost system and heated by the ambient air from approximately 20 deg F. to approximately 40 to 50 deg F. (and above 32 deg F. in any event). The heated coolant is then routed to the cooling elements within the refrigeration device, which will operate to remove accumulated ice and frost from the surfaces of the cooling elements. As shown, when the defrost system is in operation (as in the defrost mode), the temperature of refrigerated objects (shown as average product temperature, high product temperature and low product temperature) within the refrigerated case is maintained in a range between approximately 27 deg F. and below 35 deg F. According to an alternative embodiment, the coolant will be elevated in temperature at least above the ice-water freezing point (e.g. above 32 deg F.) and perhaps above 50 deg F. (if rapid defrosting is intended). According to any preferred embodiment, the defrost system will maintain the temperature of the refrigerated objects within a relatively tight or limited temperature range without dramatic temperature fluctuations. According to an alternative embodiment, the temperature of the warmed coolant may be in the range of approximately 35 deg F. to 70 deg F. According to other alternative embodiments, the operating ranges (e.g. set points, frequency, duration, etc.) may be varied according to the requirements of the application.

According to alternative embodiments, the operation of the defrost system may be controlled according to various other control criteria and parameters. For example, operation of the defrost system could be based upon monitoring of humidity and/or temperatures within the refrigeration device. The speed and/or efficacy of defrosting may be controlled by the flow rate of warmed coolant, the temperature of the coolant supply to the cooling elements, the configuration, size and shape (e.g. profile of the cooling elements), the frequency of defrosting, and environmental effects such as climate and location.

Although the defrost system is shown in operation according to exemplary embodiments with refrigeration systems employing secondary cooling, it should be noted that the defrost system could according to other exemplary embodiments be used with various other types of refrigeration systems.

According to a preferred embodiment, the duration of the defrosting mode, once initiated, is terminated by a signal from the control system when the signal from the coolant return temperature sensor indicates that a set point has been reached (e.g. an elevation in temperature to a predetermined point) correlating to an observation or empirical or other assessment that the surfaces of the cooling elements will have been sufficiently defrosted; normal operation of the primary cooling system in the cooling mode is resumed. In any preferred embodiment, the coolant return temperature provides a signal that can account for a variety of variables in the operation of the refrigeration system for determining when the defrost mode can be terminated. For example, the temperature of the coolant at the cooling element may be effected by a variety of parameters such as differences in heat transfer capacity of the heat exchanger of the defrost system, flow rates of the coolant system, the distance between the heat exchanger and the cooling elements (within the network of supply and return lines), the presence or absence of supplemental heating devices for the coolant, etc. Monitoring the discharge temperature of the coolant allows the duration of the defrost mode to be terminated at the proper time (e.g. shorter defrost period with higher temperature coolant or longer defrost period with lower temperature coolant, etc.) in a manner substantially independent of variations in the coolant supply temperature to the cooling element.

In one preferred embodiment for gravity-type refrigeration devices, the defrosting mode is terminated by a signal from control system 100 when the sensor 114 provides a signal indicating that the temperature of the coolant returned from the cooling element is approximately 45 deg F. (see FIGS. 7A AND 7B). According to an alternative embodiment, other temperatures of the coolant returned from the cooling elements may be used to signal the termination of the defrost mode according to the particular operating parameters of the system. According to another alternative embodiment, the defrost mode may be terminated by a signal from the control system in response to a signal from the timer, or may be controlled primarily by the temperature of the returned coolant with a timer providing a back-up signal intended to be used as a "default" to provide a "fail-safe" return to the cooling mode to minimize temperature variation of the objects in the event that the sensor monitoring the temperature of the returned coolant malfunctions. According to further alternative embodiments, other sensors may be used to control the operation of the defrost mode and cooling mode according to performance-based conditions such as product temperature, space temperature, coolant temperature, etc.

Referring further to FIG. 4, control system 100 may also include local, networked, or remote monitoring capability where the control device provides signals to a user interface 124 via any conventional data or communication system such as a modem and telecommunication line, where the signals provide data from the sensors to be analyzed at a local or remote location to assess system performance and for adjusting or refining the settings of the control system. Such adjustments may include, among others, changes to the timer settings for duty cycle, the duration of the defrost mode, controlling the temperature of the space, etc. Such adjustments may also be predicated upon seasonal variations in ambient conditions, changes in the use or product loading in the refrigeration device, etc.

According to a particularly preferred embodiment, the initiation of the defrost mode at a particular frequency will tend to preserve the moisture to help maintain the humidity at desirable levels within the space (and tend to reduce variation in the temperature of the products within the refrigeration device). The melted ice or frost produced during the defrost mode maintains a relatively regular supply of moisture in the air of the space in the refrigeration device through evaporation. According to a particularly preferred embodiment for gravity type refrigeration devices, moisture may help to maintain the relative humidity of the air within the space during the air circulation process to minimize drying-out of the objects so that misters, humidifiers or other moisture-introducing apparatus (which may introduce bacteria or other contaminants to the space), will not need to be used; humidity at appropriate levels may help maintain the desirable appearance, quality and marketability of the objects.

According to a particularly preferred embodiment, the coolant is provided in a loop of a secondary cooling system (that communicates with the primary refrigerant in a primary cooling system through a heat exchanger (e.g. chiller)), and has sufficient properties for use in a cooled state for cooling operation and a warmed state for defrost operation, and may be an inhibited propylene glycol or any other suitable formulation such as a saline solution, etc.

According to any preferred embodiment, the refrigeration system provides a space formed by a base, side walls, etc. provided in the case and configured to contain articles. A first element of the system provides cooling of articles within the space and includes a heat exchanger. The first element may be a heat exchanger, such as a cooling element with a cooling surface and may further include tubes or channels. A first source of fluid is provided to refrigerate the space by cooling through the first element. A second source of fluid is provided to elevate the temperature of the first element so that the first element can be in a first (e.g. cold) state and a second (e.g. frost removal) state. The second source may further include a fan for use with an ambient air source. The first source and the second source may be coupled together.

According to the exemplary embodiment shown in FIG. 1, system 10 includes a heat exchanger (shown schematically as chiller 32) between primary cooling system 30 and secondary cooling system 40 (which may be of any conventional or other type). The chiller may be located at any suitable location such as within a base portion of the refrigeration device or remote from the refrigeration device such as an equipment room, etc.

The primary cooling system (if included) may be located remotely at other suitable locations or external from the refrigeration device (such as when a common primary cooling system is used with multiple refrigeration devices). The secondary cooling system is coupled to the chiller and the primary cooling system (e.g. with field-run piping connected to suitable connections on the base).

According to a particularly preferred embodiment, the primary cooling system includes a conventional vaporcompression refrigerant in a closed-loop system having suitable equipment (shown schematically as equipment 33 in FIGS. 2A through 2E and may include an evaporator, condenser, compressor, a receiver, and an expansion device (not shown), with interconnecting tubing, valves and control components for directing the flow of a fluid (e.g. refrigerant, etc.) through the primary cooling system. According to any exemplary embodiment, the refrigerant may be a conventional refrigerant such as R-22, R-507 or R-404A (or any other suitable refrigerant such as ammonia, etc.), and the components of the primary cooling system may be commercially available components having the size and performance characteristics necessary for the refrigerant and the cooling load required by the primary cooling system. According to other exemplary embodiments, the secondary cooling system may be provided within the refrigeration device to provide a "semi self-contained" unit, the primary cooling system and the secondary cooling system may be included within a unit to provide a "self-contained" system. In another alternative embodiment, the chiller between the primary cooling system and the secondary cooling system may be located external or remote from the refrigeration device (i.e. connected by suitable supply and return lines).

According to other alternative embodiments, the refrigeration system may be a refrigerator, a freezer, a cold storage room, walk-in freezer, etc. In further alternative embodiments, the refrigeration system may be an open storage or display device such as "reach-in" type coolers that may have a fan or other device for creating an "air curtain" of cooled air that creates a boundary between warmer ambient air and the cooled space in which the objects are stored and/or displayed. According to other exemplary embodiments, the flow control elements (e.g. valves) and/or manifolds or headers (e.g. providing a supply to the cooling elements) for the system may be installed within a refrigeration device (e.g. structure) or may be external to the refrigeration device.

It is important to note that the construction and arrangement of the elements of the refrigeration system with a defrost system using ambient air provided herein are illustrative only. Although only a few exemplary embodiments of the present invention have been described in detail in this disclosure, those skilled in the art who review this disclosure will readily appreciate that many modifications are possible in these embodiments (such as variations in features such as components, formulations of coolant compositions, heat sources, orientation and configuration of the cooling elements, louvers, heat exchanger capacities and locations, the location of components and sensors of the cooling system and control system; variations in sizes, structures, shapes, dimensions and proportions of the components of the system, use of materials, colors, combinations of shapes, etc.) without materially departing from the novel teachings and advantages of the invention. For example, closed or open space refrigeration devices may be used having either horizontal or vertical access openings, and cooling elements may be provided in any number, size, orientation and arrangement to suit a particular refrigeration system; the defrost system may include a variable speed fan, under the control of the control system. Set points for the control system may be determined empirically or predetermined based on operating assumptions relating to the intended use or application of the refrigeration device. According to other alternative embodiments, the refrigeration system may be any device using a refrigerant or coolant, or a combination of a refrigerant and a coolant, for transferring heat from one space to be cooled to another space or source designed to receive the rejected heat and may include commercial, institutional or residential refrigeration systems. Further, it is readily apparent that variations of the ambient air defrost system for a refrigeration system and its components and elements may be provided in a wide variety of types, shapes, sizes and performance characteristics, or provided in locations external or partially external to the refrigeration system. Accordingly, all such modifications are intended to be within the scope of the inventions.

The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes and omissions may be made in the design, operating configuration and arrangement of the preferred and other exemplary embodiments without departing from the spirit of the inventions as expressed in the appended claims.

What is claimed is:

1. A system for refrigeration of objects, comprising:

a container defining a space adapted to receive the objects;

a first heat exchanger associated with the container for cooling a fluid communicating with the space to cool the objects;

at least one cooling element associated with the space and adapted to receive the fluid;

a second heat exchanger adapted to receive a heat supply from an air source for warming the fluid;

wherein the cooled fluid is circulated through the cooling element in a first state and the warmed fluid is circulated through the cooling element in a second state.

2. The system of claim 1 wherein the air source is an ambient air source.

3. The system of claim 1 wherein the cooling element comprises a plurality of elongated rectangular channels.

4. The system of claim 1 wherein the cooling element comprises a panel integrally formed with the container.

5. The system of claim 1 wherein the first state is a refrigeration state and the second state is a defrost state.

6. The system of claim 5 wherein the warmed fluid is adapted to remove a frost layer from the cooling element in the defrost state.

7. The system of claim 1 further comprising a control system operable to cool the fluid in the first state and to warm the fluid in the second state.

8. The system of claim 7 wherein the control system is configured to alternate operation of the system between the first state and the second state in response to a signal from a sensor.

9. The system of claim 8 wherein the sensor is a temperature sensor.

10. The system of claim 8 wherein the signal is a signal representative of time.

11. The system of claim 10 wherein the signal representative of time is empirically based to minimize variation in a temperature of the objects.

12. The system of claim 1 wherein the first heat exchanger is adapted to communicate with a refrigerant.

13. The system of claim 1 wherein the second heat exchanger includes a fan.

14. The system of claim 1 wherein the air source is a supermarket air source.

15. The system of claim 14 wherein the supermarket air source is at an elevated temperature.

16. A refrigeration device having a primary cooling system with a primary fluid in thermal communication with a first heat exchanger and a secondary cooling system with a secondary fluid in thermal communication with the first heat exchanger to cool the secondary fluid and in thermal communication with at least one cooling device adapted to provide cooling to a space to be cooled in a first mode of operation, the refrigeration device comprising:

a second heat exchanger in communication with the secondary cooling system and in communication with an ambient air heat source to warm the secondary fluid in a second mode of operation;

wherein the cooling device receives the secondary fluid in a cooled state from the first heat exchanger during the first mode of operation and the cooling device receives the secondary fluid in a warmed state from the second heat exchanger during the second mode of operation.

17. The refrigeration device of claim 16 further comprising a control system operable to direct the warmed secondary fluid to the cooling device during the second mode of operation.

18. The refrigeration device of claim 16 wherein the refrigeration device is a temperature controlled display case.

19. The refrigeration device of claim 16 wherein the first mode of operation is a cooling mode of operation and the second mode of operation is a defrost mode of operation.

20. The refrigeration device of claim 17 wherein the cooling device comprises a cooling coil.

21. The refrigeration device of claim 16 wherein the ambient air source is an air space in a supermarket.

22. The refrigeration device of claim 16 further comprising a louver device positioned adjacent to the cooling coil, where the louver device is configured to collect moisture from the cooling coil and to induce a circulation of air in the space to be cooled.

23. The refrigeration system of claim 16 wherein the cooling device comprises a panel having at least one passage for the flow of secondary coolant therethrough.

24. The refrigeration system of claim 23 wherein the panel is integrally formed with refrigeration device.

25. A defrost system for a refrigeration device having a first cooling system having a first loop in thermal communication with a second cooling system having a cooling element and first flow path configured for flow of a coolant chilled by the first cooling system during a cooling mode, the defrost system comprising:

a second flow path coupled to the first flow path;

a heat exchanger coupled to the second flow path and in thermal communication with the coolant and adapted to transfer a quantity of heat from an air source to the coolant;

a control system operable to permit flow of the coolant through the second flow path to the heat exchanger for transferring heat from the air source to the coolant during a defrost mode and operable to substantially prevent flow through the second flow path and the heat exchanger during a cooling mode;

so that the cooling element receives a flow of warmed coolant from the second flow path during the defrost mode and receives a flow of chilled coolant from the first flow path during a cooling mode.

26. The defrost system of claim 25 wherein the cooling element receives the coolant in a relatively cold state in the cooling mode and receives the coolant in a relatively warm state in the defrost mode.

27. The defrost system of claim 25 wherein the heat exchanger includes a fan device.

28. The defrost system of claim 25 wherein the air source is an ambient air source from a facility.

29. The defrost system of claim 25 wherein the coolant is a glycol solution.

30. The defrost system of claim 25 wherein the control system is operable to circulate the warmed coolant through the cooling element based on at least one control signal.

31. The defrost system of claim 25 wherein one or more parameters of the control system are determined empirically.

32. The defrost system of claim 30 wherein the control signal is a signal representative of temperature.

33. The defrost system of claim 30 wherein the control signal is a signal representative of time.

34. The defrost system of claim 33 wherein the signal representative of time is a signal from a timer having a duty cycle.

35. The defrost system of claim 34 wherein the duty cycle is determined empirically.

36. The defrost system of claim 25 wherein the control system is further configured to interrupt the defrost mode and initiate the cooling mode when the control signal is a signal representative of a predetermined temperature.

37. The defrost mode of claim 25 wherein the control system is configured for monitoring from a remote location.

38. The defrost system of claim 25 wherein the control system is configured for adjustment from a remote location.

39. A method of defrosting a refrigeration device having a first loop with a refrigerant configured to remove heat from a coolant in a second loop, the method comprising:

providing a first cooling element and a second cooling element in the refrigeration device adapted to cool a space, each cooling element communicating with the second loop;

providing a heat exchanger communicating with the second loop and adapted to transfer heat from an air source to the coolant in a first mode; and providing a control system operable to route the coolant in a first flow path when the cooling element is in the first mode and operable to route the coolant in a second flow path when the cooling element is in a second mode;

wherein the first flow path includes the heat exchanger and at least one of the first cooling element and the second cooling element, and the second flow path includes at least one of the first cooling element and the second cooling element and bypasses the heat exchanger.

40. The method of claim 39 wherein the first mode is a defrost mode and the second mode is a cooling mode.

41. The method of claim 39 wherein the first cooling element and the second cooling element are arranged in a parallel flow relationship.

42. The method of claim 39 wherein the control system is responsive to at least one control signal to alternate operation of the cooling element between the first mode and the second mode.

43. The method of claim 39 wherein the heat exchanger is located at least partially within a base of the refrigeration device.

44. The method of claim 39 wherein the air source is an ambient air source in a facility.

45. The method of claim 44 wherein the facility is a supermarket.

46. The method of claim 39 wherein the heat exchanger includes a fan.

47. The method of claim 39 wherein the refrigeration device is a temperature controlled display case.

48. An ambient air defrost system for a temperature controlled display device of a type configured for use in a supermarket having a first loop adapted to circulate a refrigerant therein and a first heat exchanger configured to transfer heat from a second loop to the first loop, the second loop adapted to circulate a coolant therein and through at least one cooling element for cooling a space within the display device, the ambient air defrost system comprising:

a defrost line having a first end and a second end coupled to the second loop upstream of the cooling element;

at least one flow control device configured to permit flow through the defrost line during a defrost mode and configured to prevent flow through the defrost line during an operating mode;

a control system operable to control operation of the flow control device in the operating mode and the defrost mode;

a second heat exchanger communicating with the defrost line, the second heat exchanger adapted to transfer heat from an ambient air source to the coolant during the defrost mode;

so that the coolant can be warmed for defrosting the cooling element using an ambient air source that is substantially independent of a heat source from the first loop.

49. The ambient air defrost system of claim 48 wherein the ambient air source is a location within the supermarket.

50. The ambient air defrost system of claim 48 wherein the second heat exchanger includes a fan device.

51. The ambient air defrost system of claim 48 wherein the second heat exchanger further comprises a plurality of channels.

52. The ambient air defrost system of claim 48 wherein the ambient air source is an elevated temperature location within the supermarket.

53. The ambient air defrost system of claim 48 wherein the control system is configured to alternate operation of the temperature controlled display case from the cooling mode to the defrost mode based on at least one predetermined control signal.

54. A system for cooling articles in a display case, comprising:

a space within the case configured to contain the articles;

a first cooling surface adapted to provide cooling of the articles within the space;

a fluid supply system providing a first flow path and a second flow path for routing a fluid to the first cooling surface;

a first heat exchanger adapted to remove heat from the fluid on the first flow path for cooling the first cooling surface in a first state; and a second heat exchanger adapted to elevate a temperature of the fluid on the second flow path for warming the first cooling surface in a second state by transferring heat from an air source to the fluid; and a flow control device configured to direct flow of the fluid through the first flow path during the first state and to direct flow of the fluid through the second flow path during the second state.

55. The system of claim 54 wherein the display case is a refrigerated display case.

56. The system of claim 54 further comprising a balance valve on the first flow path to adjust a flow rate of the fluid to the first cooling surface.

57. The system of claim 56 wherein the balance valve is located downstream of the first cooling surface.

58. The system of claim 54 further comprising a balance valve located on the second flow path and configured to adjust a flow rate of the fluid through the second heat exchanger during the second state.

59. The system of claim 54 wherein the second heat exchanger is located within a base of the display case.

60. The system of claim 54 further comprising a second cooling surface coupled to the fluid supply system and adapted to provide cooling to the articles in the space.

61. The system of claim 60 wherein the second cooling surface comprises a pan having a passages formed therein for circulating the fluid.

62. The system of claim 60 wherein the second cooling surface and the first cooling surface are configured to receive the fluid in a series flow arrangement.

63. The system of claim 60 wherein the second cooling surface and the first cooling surface are configured to receive the fluid in a parallel flow arrangement.

64. The system of claim 60 further comprising a control system configured to direct flow of the warmed fluid from the second flow path to one of the first cooling surface and the second cooling surface during the second state.

65. The system of claim 60 further comprising a control system configured to direct flow of the warmed fluid from the second flow path to each of the first cooling surface and the second cooling surface.

66. The system of claim 61 wherein the passages are formed substantially in a U shape.

67. The system of claim 54 wherein the second heat exchanger comprises a variable speed fan.

68. The system of claim 54 wherein the first heat exchanger comprises a chiller.

69. The system of claim 68 wherein the chiller is located remotely from the display device.

70. The system of claim 54 wherein the air source is an ambient air source within a supermarket.

71. The system of claim 54 wherein the flow control device comprises at least one solenoid valve.

72. The system of claim 54 further comprising a control system is configured to alternate operation of the system between the first state and the second state based on a signal representative of time.

73. The system of claim 72 wherein the signal representative of time is provided by a timing device on a frequency.

74. The system of claim 73 wherein the frequency is determined empirically.

75. A method of operating a refrigeration device adapted to operate in a cooling mode and a defrost mode and with a coolant flowing through a cooling element of a type that may tend to accumulate frost comprising:

routing the coolant through a loop to a first heat exchanger configured to cool the coolant for circulation to a cooling element during the cooling mode;

routing the coolant through a branch line coupled to the loop and through a second heat exchanger for circulation to the cooling element to a cooling element at a flow rate during the defrost mode;

wherein the second heat exchanger elevates a temperature of the coolant using ambient air so that any frost on the cooling element can be at least partially removed when the coolant is routed to the cooling element.

76. The method of claim 75 wherein the temperature has a range of approximately 35 deg F. to 70 deg F.

77. The method of claim 75 wherein the temperature has a range greater than 32 deg F.

78. The method of claim 75 wherein the flow rate has a range of approximately 1.5 GPM to 6.0 GPM.

79. The method of claim 75 further comprising monitoring at least one sensor for initiating the defrost mode.

80. The method of claim 79 wherein the sensor is configured to provide a signal representative of time.

81. The method of claim 75 further comprising monitoring at least one sensor for terminating the defrost mode.

82. The method of claim 81 wherein the sensor is configured to provide a signal representative of a coolant temperature.

83. The method of claim 75 wherein the defrost mode has a duration in a range of approximately three minutes to five minutes.

84. The method of claim 75 wherein the defrost mode has a duration in a range of approximately one minute to ten minutes.

85. The method of claim 75 wherein the defrost mode has a duration in a range of approximately one minute to 30 minutes.

86. The method of claim 75 further comprising providing a drip period following termination of the defrost mode.

87. The method of claim 86 wherein the flow rate is substantially reduced in the drip period.

88. The method of claim 87 wherein the flow rate is substantially zero.

89. The method of claim 86 wherein the drip period has a duration of approximately one minute to three minutes.

90. The method of claim 86 wherein the drip period has a duration of approximately less than one minute.

91. The method of claim 86 wherein the drip period has a duration of approximately greater than three minutes.

92. The method of claim 75 further comprising routing the coolant in a cooled state to the cooling element after termination of the defrost mode.

93. The method of claim 75 wherein the coolant is a secondary coolant.

94. A method of installing a refrigeration system having a coolant adapted to circulate in a piping network with a flow rate to a cooling element, comprising:

configuring the piping network to include at least a first flow path for cooling the cooling element and a second flow path for defrosting the cooling element;

coupling the piping network to a coolant source;

configuring a control system to transmit the coolant through the first flow path to cool the cooling element and through the second flow path to defrost the cooling element;

providing a heat exchanger on the second flow path for receiving and warming the coolant with an ambient air source; and balancing the flow rate of the coolant to the cooling element.

95. The method of claim 94 wherein the step of configuring a control system further comprises interfacing with a control device.

96. The method of claim 95 further comprising inputting data representative of a set point.

97. The method of claim 96 wherein the set point is a temperature set point.

98. The method of claim 97 wherein the temperature set point is associated with a coolant temperature.

99. The method of claim 95 further comprising entering a value representative of a time period.

100. The method of claim 94 wherein the step of balancing further comprises adjusting at least one valve.

101. The method of claim 94 wherein the flow rate is in a range of approximately 1.5 GPM to 6 GPM.

102. The method of claim 94 wherein the ambient air source is high temperature area of a facility.

* * * * *